US009850840B2

(12) United States Patent
Miyamoto et al.

(10) Patent No.: US 9,850,840 B2
(45) Date of Patent: Dec. 26, 2017

(54) DIAGNOSIS SYSTEM OF INTERNAL COMBUSTION ENGINE

(71) Applicants: Hiroshi Miyamoto, Shizuoka (JP); Yuji Miyoshi, Susono (JP); Yasushi Iwazaki, Ebina (JP); Toru Kidokoro, Hadano (JP); Keiichiro Aoki, Shizuoka (JP)

(72) Inventors: Hiroshi Miyamoto, Shizuoka (JP); Yuji Miyoshi, Susono (JP); Yasushi Iwazaki, Ebina (JP); Toru Kidokoro, Hadano (JP); Keiichiro Aoki, Shizuoka (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 41 days.

(21) Appl. No.: 14/900,792

(22) PCT Filed: Jun. 26, 2013

(86) PCT No.: PCT/JP2013/067570

§ 371 (c)(1),
(2) Date: Dec. 22, 2015

(87) PCT Pub. No.: WO2014/207854

PCT Pub. Date: Dec. 31, 2014

(65) Prior Publication Data

US 2016/0138504 A1 May 19, 2016

(51) Int. Cl.
*F02D 41/12* (2006.01)
*F02D 41/14* (2006.01)
(Continued)

(52) U.S. Cl.
CPC ..... *F02D 41/126* (2013.01); *F01N 3/08* (2013.01); *F02D 41/1439* (2013.01);
(Continued)

(58) Field of Classification Search
CPC ..... F02D 41/126; F02D 41/1439; F02D 41/1456; F02D 41/1495; F02D 41/1441;
(Continued)

(56) References Cited

U.S. PATENT DOCUMENTS

2003/0070423 A1* 4/2003 Morinaga ..... F01N 3/2006 60/284
2006/0260295 A1* 11/2006 Gielen ..... F01N 11/007 60/285
(Continued)

FOREIGN PATENT DOCUMENTS

DE 10 2008 004 207 A1 7/2009
JP 2001-242126 A 9/2001
(Continued)

*Primary Examiner* — Joseph Dallo
*Assistant Examiner* — Yi-Kai Wang
(74) *Attorney, Agent, or Firm* — Andrews Kurth Kenyon LLP

(57) ABSTRACT

An electronic control unit (ECU) of an internal combustion engine, which includes an air-fuel ratio sensor arranged at a downstream side of an exhaust purification catalyst, is configured to judge if a state of the air-fuel ratio sensor is normal or abnormal based on the first characteristic of change of air-fuel ratio and, if a judgment cannot be made based on the first characteristic, the ECU is configured to judge if the state of the air-fuel ratio sensor is normal or abnormal based on a second characteristic of change of air-fuel ratio. As a result, it is possible to suppress the effects of the change of state of the exhaust purification catalyst while accurately diagnosing the abnormality of deterioration of response of a downstream side air-fuel ratio sensor.

17 Claims, 8 Drawing Sheets

(51) Int. Cl.
*F01N 3/08* (2006.01)
*F01N 13/00* (2010.01)

(52) U.S. Cl.
CPC ..... *F02D 41/1456* (2013.01); *F02D 41/1495* (2013.01); *F01N 13/009* (2014.06); *F01N 2560/025* (2013.01); *F01N 2560/14* (2013.01); *F01N 2900/0416* (2013.01); *F02D 41/1441* (2013.01)

(58) Field of Classification Search
CPC .... F01N 3/08; F01N 13/009; F01N 2560/025; F01N 2560/14; F01N 2900/0416
USPC ..... 123/344
See application file for complete search history.

(56) References Cited

U.S. PATENT DOCUMENTS

2007/0220863 A1* 9/2007 Iida ..... F01N 13/0093 60/277
2008/0028829 A1* 2/2008 Sawada ..... F01N 3/0814 73/23.32
2009/0313970 A1* 12/2009 Iida ..... F01N 3/0814 60/276
2010/0186491 A1* 7/2010 Shibata ..... F02D 41/1495 73/114.72
2011/0106396 A1* 5/2011 Moll ..... F01N 3/0871 701/102
2011/0225951 A1 9/2011 Sato
2014/0190149 A1* 7/2014 Umemoto ..... F01N 11/007 60/276

FOREIGN PATENT DOCUMENTS

JP 2004-225684 A 8/2004
JP 2005-030358 A 2/2005
JP 2007-192093 A 8/2007
JP 2010-007534 A 1/2010
JP 2010-025090 A 2/2010
JP 2010-163904 A 7/2010
JP 2011-106415 A 6/2011
JP 2011-196230 A 10/2011
JP 2011-208605 A 10/2011
JP 2012-052462 A 3/2012
JP 2012-127356 A 7/2012

* cited by examiner

DIAGNOSIS SYSTEM OF INTERNAL COMBUSTION ENGINE

CROSS-REFERENCE TO RELATED APPLICATION

This is a national phase application based on the PCT International Patent Application No. PCT/JP2013/067570 filed Jun. 26, 2013, the entire contents of which are incorporated herein by reference.

TECHNICAL FIELD

The present invention relates to a diagnosis system of an internal combustion engine.

BACKGROUND ART

Known in the past has been an internal combustion engine providing an air-fuel ratio sensor in an exhaust passage of the internal combustion engine and controlling an amount of fuel which is fed to the internal combustion engine based on an output of the air-fuel ratio sensor.

The air-fuel ratio sensor used in such an internal combustion engine gradually deteriorates along with use. As such deterioration, for example, deterioration of response of the air-fuel ratio sensor may be mentioned. The deterioration of response of the air-fuel ratio sensor occurs due to air holes provided in a sensor cover for preventing a sensor element from being covered by water ending up being partially clogged by particulate matter (PM). If the air holes are partially clogged in this way, the exchange of gas between the inside and outside of the sensor cover becomes slower, and as a result the output of the air-fuel ratio sensor ends up becoming blunter. If such deterioration of the air-fuel ratio sensor occurs, the various control operations performed by the control system of an internal combustion engine end up being hindered.

Therefore, diagnosis systems diagnosing deterioration of air-fuel ratio sensors have been proposed (for example, see PLTs 1 to 5). As such a diagnosis system, for example, one making a target air-fuel ratio change in a step manner and along with this detecting a first response time until an output value of the air-fuel ratio sensor reaches a first predetermined value and a second response time larger than the first predetermined value and using the two times of the first response time and the second response time as the basis to judge deterioration of the air-fuel ratio sensor has been proposed (for example, PLT 1). Here, as patterns of deterioration of an air-fuel ratio sensor, there is deterioration of response where the response time becomes slower and deterioration of gain where the response itself increases or decreases. As opposed to this, according to the diagnosis system described in PLT 1, by using the first response time and the second response time as the basis to judge deterioration of an air-fuel ratio sensor, it is considered possible to accurately identify by which of the two patterns of deterioration the deterioration of the air-fuel ratio sensor is being caused.

CITATIONS LIST

Patent Literature

PLT 1: Japanese Patent Publication No. 2007-192093A
PLT 2: Japanese Patent Publication No. 2011-196230A PLT 3: Japanese Patent Publication No. 2001-242126A
PLT 4: Japanese Patent Publication No. 2011-106415A

SUMMARY OF INVENTION

Technical Problem

In this regard, deterioration of response of an air-fuel ratio sensor is diagnosed by making the air-fuel ratio of the exhaust gas flowing out from the internal combustion engine change in steps and detecting the response of the air-fuel ratio sensor with respect to this step like change. Further, the greater the extent by which the air-fuel ratio of the exhaust gas discharged from the internal combustion engine is made to change in steps, the higher the precision of diagnosis of the deterioration of response.

Here, when performing fuel cut control stopping or greatly decreasing the feed of fuel to the combustion chambers, the air-fuel ratio of the exhaust gas flowing out from the exhaust purification catalyst becomes leaner than the stoichiometric air-fuel ratio. The lean degree becomes extremely large. Therefore, right after the start of fuel cut control or right after the end of fuel cut control, the air-fuel ratio of the exhaust gas exhausted from the internal combustion engine is made to greatly change in steps. For this reason, right after the start of fuel cut control or right after the end of fuel cut control, high precision diagnosis of deterioration of response is possible.

On the other hand, in an internal combustion engine using the output of an air-fuel ratio sensor as the basis to control a fuel amount, an air-fuel ratio sensor is often provided at the downstream side of the exhaust purification catalyst as well. In such a case, the exhaust gas discharged from the internal combustion engine passes through the exhaust purification catalyst then reaches the downstream side air-fuel ratio sensor. For this reason, when the exhaust purification catalyst has an oxygen storage ability, the air-fuel ratio of the exhaust gas reaching the downstream side air-fuel ratio sensor changes in accordance with not only the exhaust gas discharged from the internal combustion engine, but also the oxygen storage ability, oxygen storage amount, etc. of the exhaust purification catalyst.

For this reason, when, as mentioned above, making the air-fuel ratio of the exhaust gas discharged from the internal combustion engine greatly change in a step like manner so as to diagnose deterioration of response, sometimes the output of the downstream side air-fuel ratio sensor ends up changing in accordance with the state of the exhaust purification catalyst. In such a case, even if the actual response of the downstream side air-fuel ratio sensor is constant, if the state of the exhaust purification catalyst changes, along with this, the output of the downstream side air-fuel ratio sensor will end up changing.

As opposed to this, for example, if diagnosing deterioration of response right after the end of fuel cut control, it is possible to perform the diagnosis in a state grasping the oxygen storage amount in the exhaust purification catalyst. For this reason, it is possible to reduce the effect of the state of the exhaust purification catalyst on the output of the downstream side air-fuel ratio sensor and, as a result, raise the precision of diagnosis of deterioration of response of the downstream side air-fuel ratio sensor.

However, even if diagnosing deterioration of response right after the end of fuel cut control in this way, the output of the downstream side air-fuel ratio sensor still changes according to the state of the exhaust purification catalyst.

Further, if the output of the downstream side air-fuel ratio sensor changes according to the state of the exhaust purification catalyst in this way, it ends up no longer possible to accurately diagnose deterioration of response of the downstream side air-fuel ratio sensor.

Therefore, in view of the above problems, an object of the present invention is to provide a diagnosis system of an internal combustion engine able to suppress the effects of the change of state of the exhaust purification catalyst while accurately diagnosing the abnormality of deterioration of response of a downstream side air-fuel ratio sensor.

Solution to Problem

In order to solve the above problem, in a first invention, there is provided a diagnosis system of an internal combustion engine comprising an exhaust purification catalyst arranged in an exhaust passage of the internal combustion engine and being able to store oxygen in inflowing exhaust gas and an air-fuel ratio sensor arranged at a downstream side of the exhaust purification catalyst in a direction of exhaust flow and detecting an air-fuel ratio of exhaust gas flowing out from the exhaust purification catalyst, stopping or decreasing a feed of fuel to a combustion chamber as fuel cut control, and controlling an air-fuel ratio of exhaust gas flowing into the exhaust purification catalyst after the end of the fuel cut control to a rich air-fuel ratio richer than a stoichiometric air-fuel ratio as post reset rich control, wherein the diagnosis system comprises a first change characteristic calculating means for calculating a first characteristic of change of air-fuel ratio at the time the output air-fuel ratio of the air-fuel ratio sensor first passes a first air-fuel ratio region which is a part of an air-fuel ratio region of a stoichiometric air-fuel ratio or more, after ending of the fuel cut control, based on an output air-fuel ratio output from the air-fuel ratio sensor, a second change characteristic calculating means for calculating a second characteristic of change of air-fuel ratio at the time the output air-fuel ratio of the air-fuel ratio sensor first passes a second air-fuel ratio region different from the first air-fuel ratio region, after ending of the fuel cut control, based on an output air-fuel ratio output from the air-fuel ratio sensor, and an abnormality diagnosing means for judging any one of normality, abnormality, and whether a hold should be put on judgment for the state of the air-fuel ratio sensor, based on the first characteristic of change of air-fuel ratio and, if it is judged based on the first characteristic of change of air-fuel ratio that a hold should be put on judgment, for judging if the state of the air-fuel ratio sensor is normal or abnormal based on the second characteristic of change of air-fuel ratio.

In a second invention, the first air-fuel ratio region includes an air-fuel ratio region leaner than the second air-fuel ratio region in the first invention.

In a third invention, the second air-fuel ratio region includes an air-fuel ratio region richer than the first air-fuel ratio region in the first or second invention.

In a forth invention, the second air-fuel ratio region is a region including a stoichiometric air-fuel ratio in any one of the first to third inventions.

In a fifth invention, the air-fuel ratio sensor is a limit current type air-fuel ratio sensor outputting a limit current when an air-fuel ratio of exhaust gas passing through the air-fuel ratio sensor is within a predetermined air-fuel ratio region, and the first air-fuel ratio region and the second air-fuel ratio region are within the predetermined air-fuel ratio where the air-fuel ratio sensor generates a limit current in any one of the first to four inventions.

In a sixth invention, the first air-fuel ratio region is a region between a first region upper limit air-fuel ratio and a first region lower limit air-fuel ratio at a rich side from the first region upper limit air-fuel ratio, the second air-fuel ratio region is a region between a second region upper limit air-fuel ratio and a second region lower limit air-fuel ratio at a rich side from the second region upper limit air-fuel ratio, and the second region upper limit air-fuel ratio is leaner than the stoichiometric air-fuel ratio in any one of the first to fifth inventions.

In a seventh invention, the second region upper limit air-fuel ratio is richer than the first region lower limit air-fuel ratio in the sixth invention.

In an eighth invention, the second region lower limit air-fuel ratio is the stoichiometric air-fuel ratio or less in the sixth or seventh invention.

In a ninth invention, the first characteristic of change of air-fuel ratio is a first speed of change of air-fuel ratio which is a speed of change when an output air-fuel ratio of the air-fuel ratio sensor first passes through the first air-fuel ratio region, and the abnormality diagnosing means judges that the air-fuel ratio sensor is abnormal when the first speed of change of air-fuel ratio is slower than a speed of change used as reference for abnormality, judges that the air-fuel ratio sensor is normal when the first speed of change of air-fuel ratio is faster than a speed of change used as reference for normality, and judges that a hold should be put on judgment when the first speed of change of air-fuel ratio is between the speed of change used as reference for abnormality and the speed of change used as reference for normality in any one of the first to eighth inventions.

In a tenth invention, the second characteristic of change of air-fuel ratio is a second speed of change of air-fuel ratio which is a speed of change when an output air-fuel ratio of the air-fuel ratio sensor first passes through the second air-fuel ratio region, and the abnormality diagnosing means, when it is judged based on the first characteristic of change of air-fuel ratio that a hold should be put on judgment, judges that the air-fuel ratio sensor is normal if the second speed of change of air-fuel ratio is slower than a speed of change used as reference for judgment of normality and abnormality and judges that the air-fuel ratio sensor is abnormal if the second speed of change of air-fuel ratio is faster than the speed of change used as reference for judgment of normality and abnormality in any one of the first to ninth inventions.

In a eleventh invention, the speed of change of air-fuel ratio is calculated based on the time period during which the output air-fuel ratio of the air-fuel ratio sensor changes from the upper limit air-fuel ratio to the lower limit air-fuel ratio of the corresponding air-fuel ratio region in the ninth or tenth invention.

In a twelfth invention, the first characteristic of change of air-fuel ratio is a first cumulative value of air-fuel ratio obtained by cumulatively adding the output air-fuel ratio when an output air-fuel ratio of the air-fuel ratio sensor is in the first air-fuel ratio region, and the abnormality diagnosing means judges that the air-fuel ratio sensor is abnormal when the first cumulative value of air-fuel ratio is larger than a cumulative value used as reference for abnormality, judges that the air-fuel ratio sensor is normal when the first cumulative value of air-fuel ratio is smaller than a cumulative value used as reference for normality, and judges that a hold should be put on judgment when the first cumulative value of air-fuel ratio is between the cumulative value used as reference for abnormality and the cumulative value used as reference for normality in any one of the first to eighth, tenth and eleventh inventions.

In a thirteenth invention, the second characteristic of change of air-fuel ratio is a second cumulative value of air-fuel ratio obtained by cumulatively adding the output air-fuel ratio when an output air-fuel ratio of the air-fuel ratio sensor is in the second air-fuel ratio region, and the abnormality diagnosing means judges, when it is judged based on the first characteristic of change of air-fuel ratio that a hold should be put on judgment, that the air-fuel ratio sensor is normal when the second cumulative value of air-fuel ratio is larger than a cumulative value used as reference for judgment of normality and abnormality and judges that the air-fuel ratio sensor is abnormal when the second cumulative value of air-fuel ratio is smaller than the cumulative value used as reference for judgment of normality and abnormality in any one of the first to ninth, eleventh and twelfth inventions.

In a fourteenth invention, the first characteristic of change of air-fuel ratio is a first cumulative value of amount of exhaust gas obtained by cumulatively adding an amount of exhaust gas passing through an exhaust passage in which the air-fuel ratio sensor is arranged in the period from when an output air-fuel ratio of the air-fuel ratio sensor changes from an upper limit air-fuel ratio to a lower limit air-fuel ratio of the first air-fuel ratio region, and the abnormality diagnosing means judges that the air-fuel ratio sensor is abnormal when the first cumulative value of amount of exhaust gas is larger than a cumulative value used as reference for abnormality, judges that the air-fuel ratio sensor is normal when the first cumulative value of amount of exhaust gas is smaller than a cumulative value used as reference for normality, and judges that a hold should be put on judgment when the first cumulative value of amount of exhaust gas is between the cumulative value used as reference for abnormality and the cumulative value used as reference for normality in any one of the first to eighth, tenth, eleventh and thirteenth inventions.

In a fifteenth invention, the second characteristic of change of air-fuel ratio is a second cumulative value of amount of exhaust gas obtained by cumulatively adding the amount of exhaust gas passing through the exhaust passage in which the air-fuel ratio sensor is arranged in the period from when the output air-fuel ratio of the air-fuel ratio sensor changes from the upper limit air-fuel ratio to the lower limit air-fuel ratio of the second air-fuel ratio region, and the abnormality diagnosing means, when it is judged based on the first characteristic of change of air-fuel ratio that a hold should be put on judgment, judges that the air-fuel ratio sensor is normal when the second cumulative value of amount of exhaust gas is larger than a cumulative value used as reference for judgment of normality and abnormality and judges that the air-fuel ratio sensor is abnormal when the second cumulative value of amount of exhaust gas is smaller than the cumulative value used as reference for judgment of normality and abnormality in any one of the first to ninth, eleventh, twelfth and fourteenth inventions.

In a sixteenth invention, the abnormality diagnosing means judges that the exhaust purification catalyst is deteriorating when it is judged based on the first characteristic of change of air-fuel ratio that the air-fuel ratio sensor is normal and when it is judged based on the second characteristic of change of air-fuel ratio that the air-fuel ratio sensor is abnormal in any one of the first to fifteenth inventions.

In a seventeenth invention, the diagnosis system of an internal combustion engine further comprises a warning means for lighting a warning light when the abnormality diagnosing means judges that the air-fuel ratio sensor is abnormal in any one of the first to sixteenth inventions.

Advantageous Effects of Invention

According to the present invention, there is provided a diagnosis system of an internal combustion engine able to suppress the effects of the change of state of the exhaust purification catalyst while accurately diagnosing the abnormality of deterioration of response of a downstream side air-fuel ratio sensor.

DESCRIPTION OF EMBODIMENTS

Figure 1:
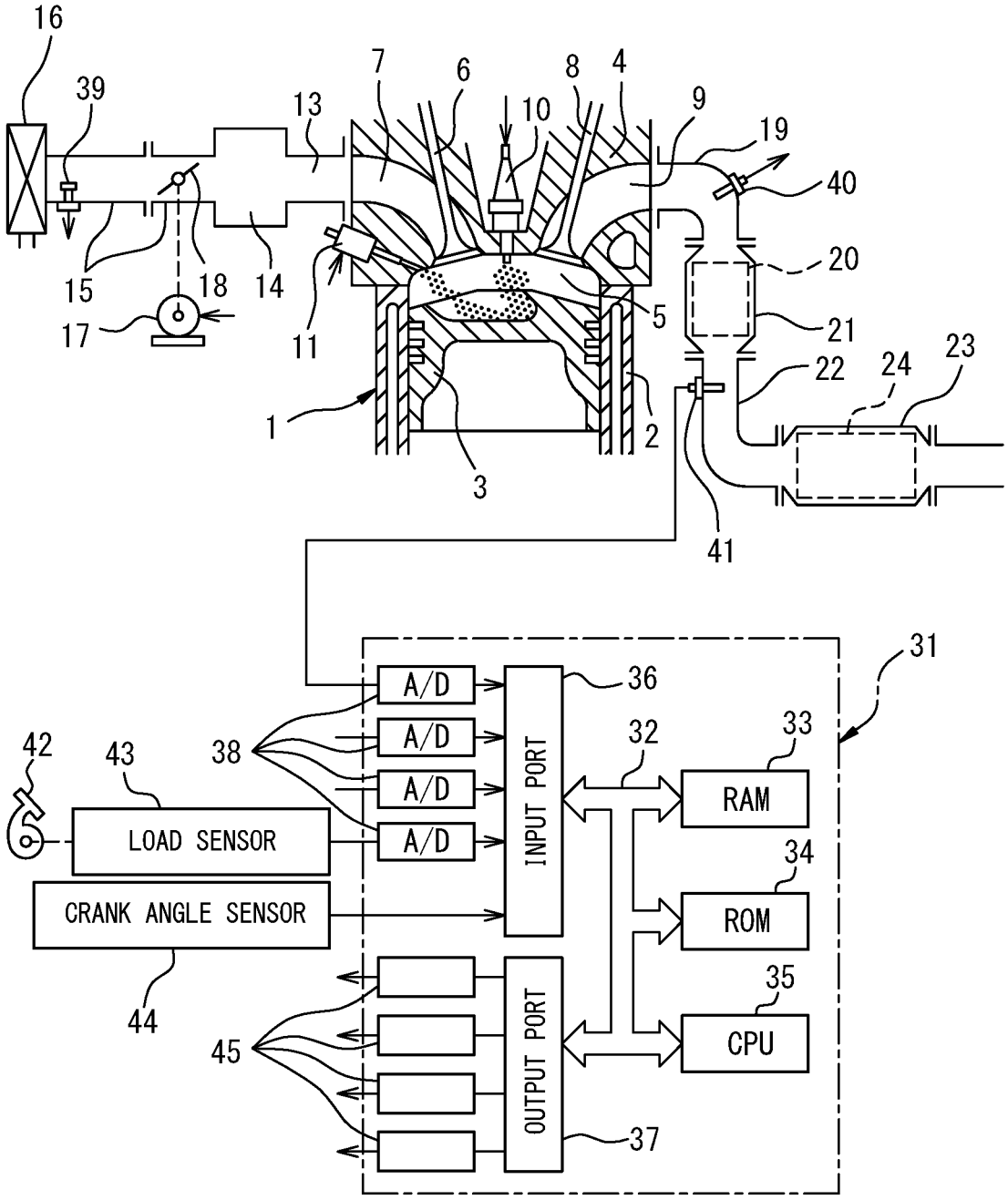
FIG. 1 is a view schematically showing an internal combustion engine in which the diagnosis system of the present invention is used.

Referring to the drawings, a diagnosis system of an internal combustion engine of the present invention will be explained in detail below. Note that, in the following explanation, similar component elements are assigned the same reference numerals. FIG. 1 is a view which schematically shows an internal combustion engine in which a control system according to a first embodiment of the present invention is used.

<Explanation of Internal Combustion Engine as a Whole>

Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, at the center part of the inside wall surface of the cylinder head 4, a spark plug 10 is arranged. A fuel injector 11 is arranged around the inside wall surface of the cylinder head 4. The spark plug 10 is configured to cause generation of a spark in accordance with an ignition signal. Further, the fuel injector 11 injects a predetermined amount of fuel into the combustion chamber 5 in accordance with an injection signal. Note that, the fuel injector 11 may be arranged so as to inject fuel inside the intake port 7.

Further, in the present embodiment, as the fuel, gasoline with a stoichiometric air-fuel ratio of 14.6 is used. However, in the internal combustion engine in which the diagnosis system of the present invention is used, another fuel may also be used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side exhaust purification catalyst 20 built into it. The upstream side casing 21 is connected through an exhaust pipe 22 to a downstream side casing 23 which has a downstream side exhaust purification catalyst 24 built into it. The exhaust port 9, exhaust manifold 19, upstream side casing 21, exhaust pipe 22, and downstream side casing 23 form an exhaust passage.

The electronic control unit (ECU) 31 is comprised of a digital computer provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17.

<Explanation of Exhaust Purification Catalyst>

The upstream side exhaust purification catalyst 20 and downstream side exhaust purification catalyst 24 both have similar configurations. Below, only the upstream side exhaust purification catalyst 20 will be explained, but the downstream side exhaust purification catalyst 24 also has a similar configuration and actions.

The upstream side exhaust purification catalyst 20 is a three-way catalyst having an oxygen storage ability. Specifically, the upstream side exhaust purification catalyst 20 is comprised of a carrier made of ceramic on which a precious metal having a catalytic action (for example, platinum (Pt)) and a substance having an oxygen storage ability (for example, ceria ($CeO_2$)) are carried. The upstream side exhaust purification catalyst 20 has an oxygen storage ability in addition to a catalytic action simultaneously removing the unburned gas (HC, CO, etc.) and nitrogen oxides ($NO_X$) if reaching a predetermined activation temperature.

According to the oxygen storage ability of the upstream side exhaust purification catalyst 20, the upstream side exhaust purification catalyst 20 stores the oxygen in the exhaust gas when the air-fuel ratio of the exhaust gas flowing into the upstream side exhaust purification catalyst 20 is leaner than the stoichiometric air-fuel ratio (below referred to as the "lean air-fuel ratio"). On the other hand, the upstream side exhaust purification catalyst 20 releases the oxygen stored in the upstream side exhaust purification catalyst 20 when the air-fuel ratio of the inflowing exhaust gas is richer than the stoichiometric air-fuel ratio (below, referred to as the "rich air-fuel ratio"). Note that, the "air-fuel ratio of the exhaust gas" means the ratio of the mass of the fuel to the mass of the air supplied until the exhaust gas is generated. Usually, it means the ratio of the mass of the fuel to the mass of the air fed into a combustion chamber 5. In this Description, sometimes the air-fuel ratio of the exhaust gas will be referred to as the "exhaust air-fuel ratio".

The upstream side exhaust purification catalyst 20 has a catalyzing action and an oxygen storage ability and therefore has an action of removing $NO_X$ and unburned gas in accordance with the oxygen storage amount. If the air-fuel ratio of the exhaust gas flowing into the upstream side exhaust purification catalyst 20 is a lean air-fuel ratio, when the oxygen storage amount is small, the upstream side exhaust purification catalyst 20 will store the oxygen in the exhaust gas and along with this the $NO_X$ will be reduced. However, there are limits to the oxygen storage ability. If the oxygen storage amount of the upstream side exhaust purification catalyst 20 exceeds the upper limit storage amount, the upstream side exhaust purification catalyst 20 will no longer store almost any further oxygen. In this case, if the air-fuel ratio of the exhaust gas flowing into the upstream side exhaust purification catalyst 20 is the lean air-fuel ratio, air-fuel ratio of the exhaust gas flowing out from the upstream side exhaust purification catalyst 20 will also become the lean air-fuel ratio.

On the other hand, if the air-fuel ratio of the exhaust gas flowing into the upstream side exhaust purification catalyst 20 is a rich air-fuel ratio, when the oxygen storage amount is large, the oxygen stored in the upstream side exhaust purification catalyst 20 will be released and the unburned gas in the exhaust gas will be removed by oxidation. However, if the oxygen storage amount of the upstream side exhaust purification catalyst 20 becomes smaller and falls below the lower limit storage amount, the upstream side exhaust purification catalyst 20 will no longer release almost any further oxygen. In this case, if the air-fuel ratio of the exhaust gas flowing into the upstream side exhaust purification catalyst 20 is the rich air-fuel ratio, the air-fuel ratio of the exhaust gas flowing out from the upstream side exhaust purification catalyst 20 will also become a rich air-fuel ratio.

As explained above, according to the exhaust purification catalysts 20, 24 used in the present embodiment, the property of removal of the $NO_X$ and unburned gas in the exhaust gas changes in accordance with the air-fuel ratio of the exhaust gas flowing into the exhaust purification catalyst and the oxygen storage amount. It should be noted that the exhaust purification catalysts 20, 24 may also be catalysts different from three-way catalysts, as long as they have a catalytic action and oxygen storage ability.

<Explanation of Air-Fuel Ratio Sensor>

Figure 2:
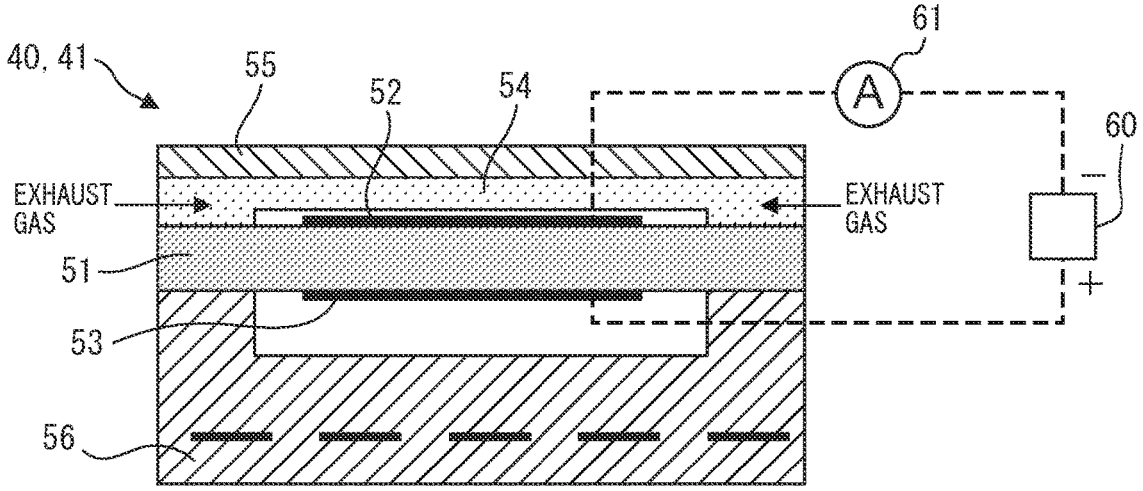
FIG. 2 is a schematic cross-sectional view of an air-fuel ratio sensor.

In the present embodiment, as the air-fuel ratio sensors 40, 41, limit current type air-fuel ratio sensors are used. FIG. 2 will be used to simply explain the structures of the air-fuel ratio sensors 40, 41. The air-fuel ratio sensors 40, 41 are provided with solid electrolyte layers 51, exhaust side electrodes 52 arranged on one side face of the same, atmosphere side electrodes 53 arranged on the other side face of the same, diffusion regulating layers 54 regulating diffusion of the passing exhaust gas, protective layers 55 protecting the diffusion regulating layers 54, and heater parts 56 heating the air-fuel ratio sensors 40, 41.

Each solid electrolyte layer 51 is formed from a sintered body of an oxygen ion conductive oxide such as $ZrO_2$ (zirconia), $HfO_2$, $ThO_2$, $Bi_2O_3$, etc. in which CaO, MgO, $Y_2O_3$, $Yb_2O_3$, etc. is added as a stabilizer. Further, the diffusion regulating layer 54 is formed from a porous sintered body of alumina, magnesia, silica, spinel, mullite, or other heat resistant inorganic substance. Further, the exhaust side electrode 52 and the atmosphere side electrode 53 are formed by platinum or another precious metal with a high catalytic activity.

Further, between the exhaust side electrode and the atmosphere side electrode, a voltage applying device 60 mounted in the ECU 31 is used to apply the sensor applied voltage V. In addition, the ECU 31 is provided with a current detection device 61 detecting the current I flowing between these electrodes 52, 53 through the solid electrolyte layer when applying the sensor applied voltage. The current detected by this current detection device 61 is the output current of the air-fuel ratio sensors 40, 41.

Figure 3:
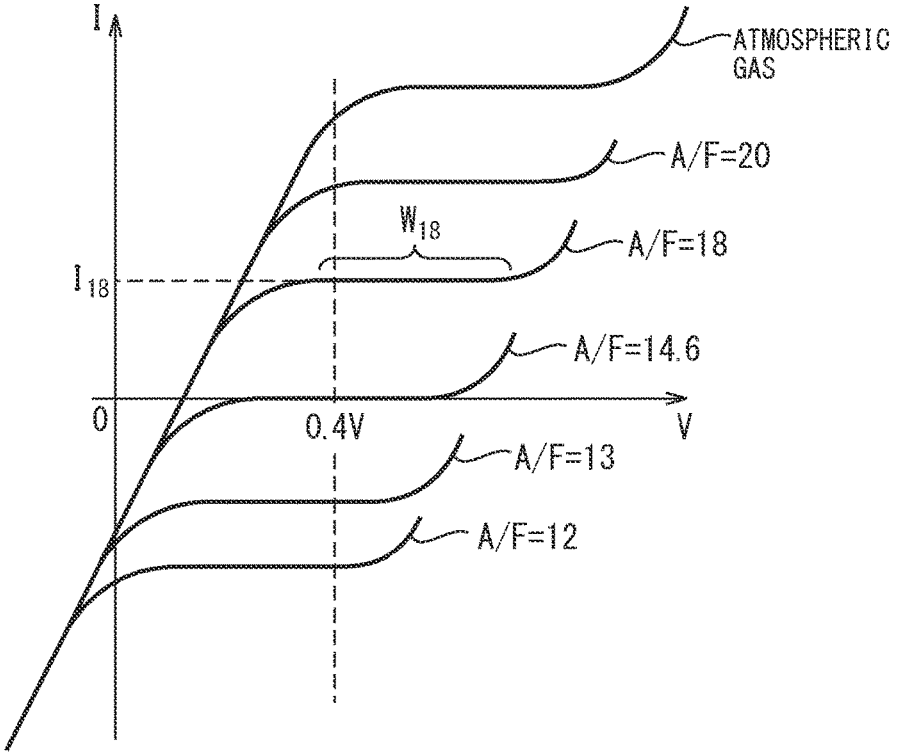
FIG. 3 is a view showing the relationship between a sensor applied voltage and output current at each exhaust air-fuel ratio.

The thus configured air-fuel ratio sensors 40, 41 have voltage-current (V-I) characteristics such as shown in FIG. 3. As will be understood from FIG. 3, the output current (I) becomes larger the larger (the leaner) the exhaust air-fuel ratio. Further, the line V-I at each exhaust air-fuel ratio has a region parallel to the V axis, that is, a region where even if the sensor applied voltage changes, the output current will not change much at all. This voltage region is called the "limit current region". The current at this time is called the "limit current". In FIG. 3, the limit current region and the limit current when the exhaust air-fuel ratio is 18 are respectively shown by $W_{18}$ and $I_{18}$.

On the other hand, in the region where the sensor applied voltage is lower than the limit current region, the output current changes substantially proportionally to the sensor applied voltage. Such a region is called a "proportional region". The slope at this time is determined by the DC element resistance of the solid electrolyte layer 51. Further, in the region where the sensor applied voltage is higher than the limit current region, the output current also increases along with an increase in the sensor applied voltage. In this region, on the exhaust side electrode 52, the moisture included in the exhaust gas breaks down etc. whereby the output voltage changes according to the change in the sensor applied voltage.

Figure 4:
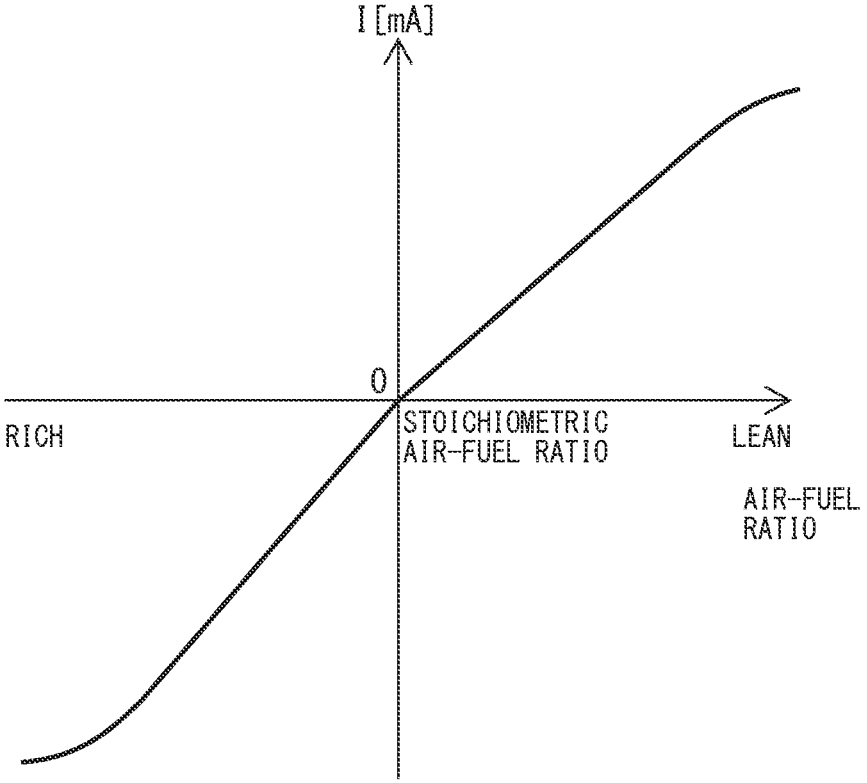
FIG. 4 is a view showing the relationship between an exhaust air-fuel ratio and output current when making the applied voltage constant.

FIG. 4 is a view showing a relationship between an exhaust air-fuel ratio and output current I when making the applied voltage a constant 0.4V or so. As will be understood from FIG. 4, at the air-fuel ratio sensors 40, 41, the larger the exhaust air-fuel ratio becomes (that is, the leaner), the larger the output current I from the air-fuel ratio sensors 40, 41. In addition, the air-fuel ratio sensors 40, 41 are configured so that when the exhaust air-fuel ratio is the stoichiometric air-fuel ratio, the output current I becomes zero. Further, when the exhaust air-fuel ratio becomes larger than a certain amount or more (in the present embodiment, 18 or more) or when it becomes smaller than a certain amount or less, the ratio of change of the output current to the change of the exhaust air-fuel ratio becomes smaller.

Note that, in the above example, limit current type air-fuel ratio sensors of the structure shown in FIG. 2 are used as the air-fuel ratio sensors 40, 41. However, so long as the output value changes smoothly with respect to a change in the exhaust air-fuel ratio at least near the stoichiometric air-fuel ratio, another structure of a limit current type air-fuel ratio sensor or an air-fuel ratio sensor not of the limit current type or any other air-fuel ratio sensor may be used.

<Basic Control>

In the thus configured internal combustion engine, based on the outputs of the upstream side air-fuel ratio sensor 40 and the downstream side air-fuel ratio sensor 41, the fuel injection amount from a fuel injector 11 etc. is set so that the air-fuel ratio of the exhaust gas flowing into the upstream side exhaust purification catalyst 20 becomes the optimum target air-fuel ratio based on the engine operating condition. As such a method of setting the fuel injection amount, the method of using the output of the upstream side air-fuel ratio sensor 40 as the basis for controlling the air-fuel ratio of the exhaust gas flowing into the upstream side exhaust purification catalyst 20 so as to become the target air-fuel ratio and using the output of the downstream side air-fuel ratio sensor 41 as the basis for correcting the output of the upstream side air-fuel ratio sensor 40 or changing the target air-fuel ratio may be mentioned.

Further, in the internal combustion engine according to an embodiment of the present invention, at the time of deceleration of the vehicle mounting the internal combustion engine etc., the fuel injection from a fuel injector 11 is stopped or greatly decreased to stop or greatly decrease the supply of fuel to the inside of a combustion chamber 5 as "fuel cut control". This fuel cut control is, for example, performed when the amount of depression of the accelerator pedal 42 is zero or substantially zero (that is, the engine load is zero or substantially zero) and the engine speed is a predetermined speed higher than the speed at the time of idling or is higher than the predetermined speed.

When fuel cut control is performed, air or exhaust gas like air is exhausted from the internal combustion engine, and therefore gas with an extremely high air-fuel ratio (i.e. an extremely high lean degree) flows into the upstream side exhaust purification catalyst 20. As a result, during fuel cut control, a large amount of oxygen flows into the upstream side exhaust purification catalyst 20, and the oxygen storage amount of the upstream side exhaust purification catalyst 20 reaches the upper limit storage amount.

Further, in the internal combustion engine of the present embodiment, during fuel cut control, oxygen stored in the upstream side exhaust purification catalyst 20 is made to be released by making the air-fuel ratio of the exhaust gas flowing into the upstream side exhaust purification catalyst 20 the rich air-fuel ratio right after the end of the fuel cut control as "post reset rich control". This state is shown in FIG. 5.

Figure 5:
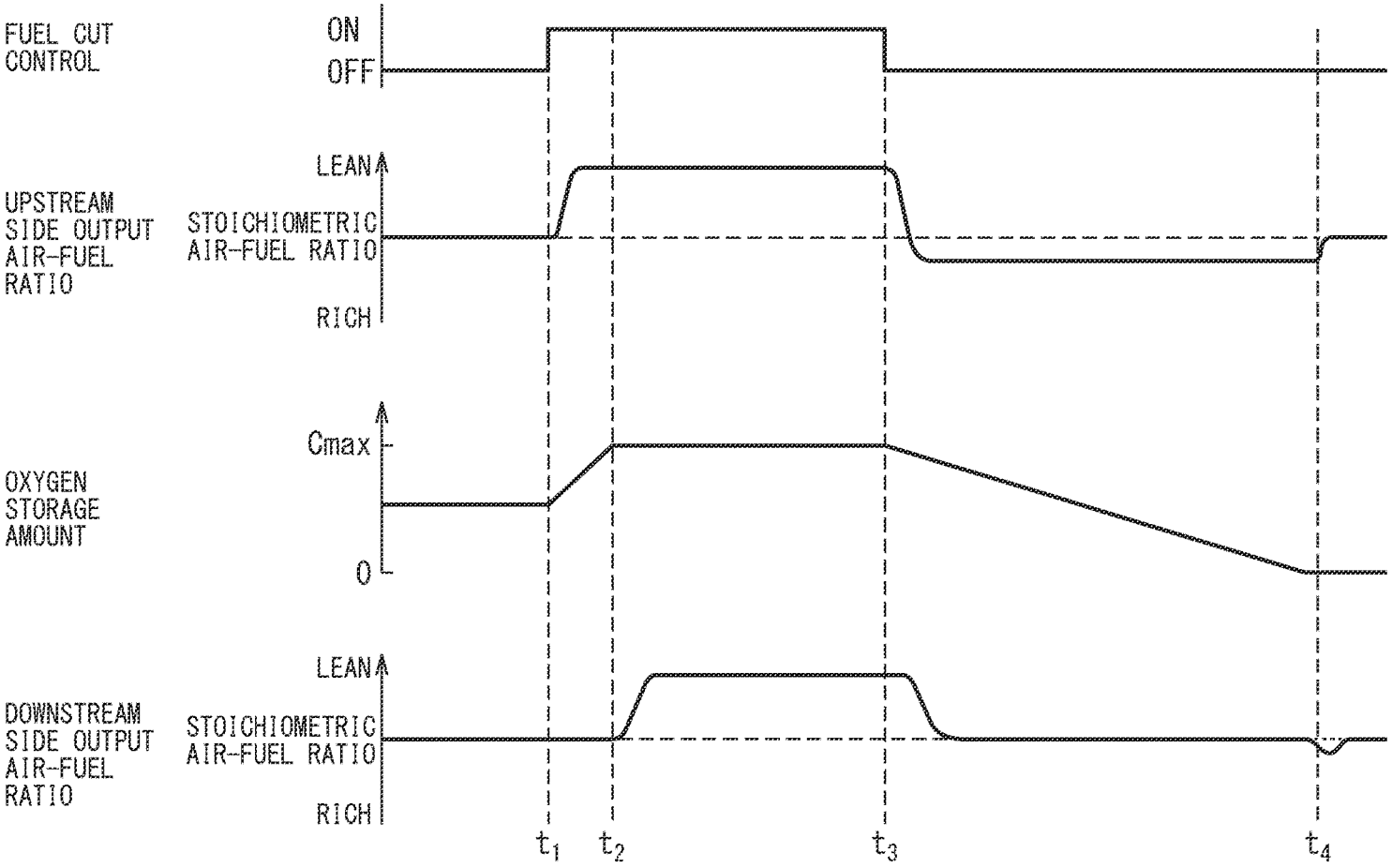
FIG. 5 is a time chart of an upstream side output air-fuel ratio and downstream side output air-fuel ratio etc. before and after fuel cut control.

FIG. 5 is a time chart of the air-fuel ratio corresponding to the output value of the upstream side air-fuel ratio sensor 40 (below, referred to as the "upstream side output air-fuel ratio"), the oxygen storage amount of the upstream side exhaust purification catalyst 20, and the air-fuel ratio corresponding to the output value of the downstream side air-fuel ratio sensor 41 (below, referred to as the "downstream side output air-fuel ratio") when performing fuel cut control. In the illustrated example, the fuel cut control is started at the time $t_1$ and the fuel cut control is ended at the time $t_3$.

In the illustrated example, if fuel cut control is made to start at the time $t_1$, lean air-fuel ratio exhaust gas is discharged from the engine body 1. Along with this, the output air-fuel ratio of the upstream side air-fuel ratio sensor 40 increases. At this time, the oxygen in the exhaust gas flowing into the upstream side exhaust purification catalyst 20 is stored in the upstream side exhaust purification catalyst 20, and therefore the oxygen storage amount of the upstream side exhaust purification catalyst 20 increases, while the output air-fuel ratio of the downstream side air-fuel ratio sensor 41 remains as the stoichiometric air-fuel ratio.

After that, when, at the time $t_2$, the oxygen storage amount of the upstream side exhaust purification catalyst 20 reaches the upper limit storage amount (Cmax), the upstream side exhaust purification catalyst 20 can no longer store any more oxygen. For this reason, after the time $t_2$, the output air-fuel ratio of the downstream side air-fuel ratio sensor 41 becomes leaner than the stoichiometric air-fuel ratio.

If, at the time $t_3$, fuel cut control is made to end, to make the upstream side exhaust purification catalyst 20 release the oxygen stored during fuel cut control, post reset rich control is performed. In the post reset rich control, an air-fuel ratio slightly richer than the stoichiometric air-fuel ratio is exhausted from the engine body 1. Along with this, the output air-fuel ratio of the upstream side air-fuel ratio sensor 40 becomes the rich air-fuel ratio and the oxygen storage amount of the upstream side exhaust purification catalyst 20 gradually decreases. At this time, even if rich air-fuel ratio exhaust gas is made to flow into the upstream side exhaust purification catalyst 20, the oxygen stored in the upstream side exhaust purification catalyst 20 and the unburned gas in the exhaust gas react, and therefore the air-fuel ratio of the exhaust gas exhausted from the upstream side exhaust purification catalyst 20 becomes substantially the stoichiometric air-fuel ratio. For this reason, the output air-fuel ratio of the downstream side air-fuel ratio sensor 41 becomes substantially the stoichiometric air-fuel ratio.

If the oxygen storage amount continues to decrease, finally the oxygen storage amount becomes substantially zero and unburned gas flows out from the upstream side exhaust purification catalyst 20. Due to this, at the time $t_4$, the exhaust air-fuel ratio detected by the downstream side air-fuel ratio sensor 41 becomes richer than the stoichiometric air-fuel ratio. If in this way the output air-fuel ratio of the downstream side air-fuel ratio sensor 41 reaches an end judgment air-fuel ratio slightly richer than the stoichiometric air-fuel ratio, the post reset rich control is made to end. After that, normal air-fuel ratio control is started. In the illustrated example, the air-fuel ratio of the exhaust gas exhausted from the engine body is controlled to become the stoichiometric air-fuel ratio.

It should be noted that the condition for ending post reset rich control need not necessarily be the time when the downstream side air-fuel ratio sensor 41 detects the rich air-fuel ratio. For example, the control may also be ended when a certain time period elapses after the end of fuel cut control or under other conditions.

<Problem in Diagnosis of Deterioration of Response>

As explained above, when setting the fuel injection amount based on the air-fuel ratio sensors 40, 41, if the air-fuel ratio sensors 40, 41 become abnormal and the precision of output of the air-fuel ratio sensors 40, 41 ends up deteriorating, it no longer becomes possible to optimally set the fuel injection amount. As a result, deterioration of the exhaust emissions and deterioration of the fuel economy end up being invited. For this reason, in many internal combustion engines, a diagnosis system is provided for self-diagnosing abnormality of the air-fuel ratio sensors 40, 41.

In this regard, as such an abnormality of output of the air-fuel ratio sensors 40, 41, deterioration of response may be mentioned. Deterioration of response of the air-fuel ratio sensor, for example, occurs due to air holes provided in a sensor cover (cover provided at outside from protective layer 55) for preventing a sensor element from being covered by water ending up being partially clogged by particulate matter (PM). The state of the trends in an air-fuel ratio sensor when such deterioration of response occurs is shown in FIG. 6.

Figure 6:
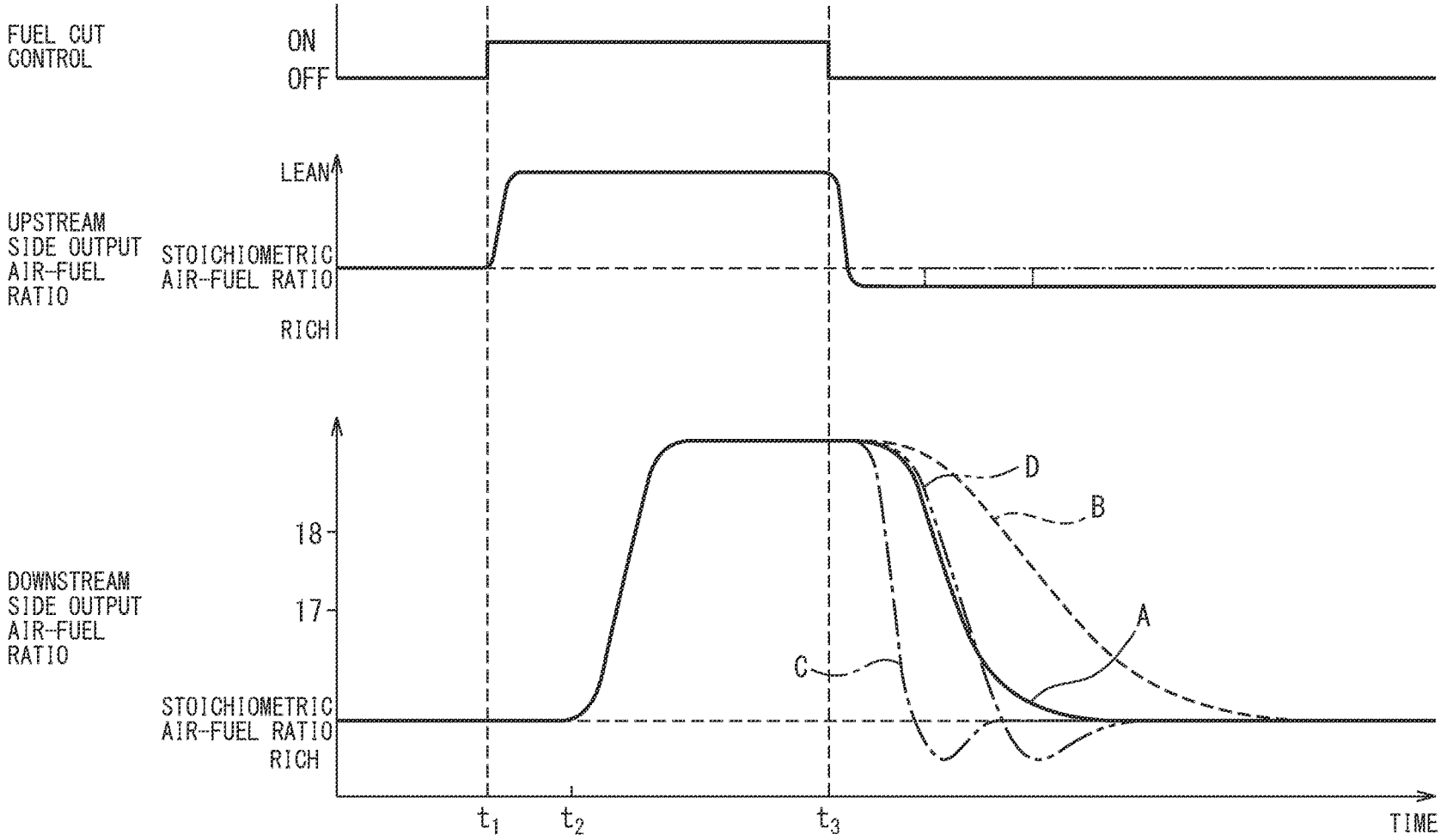
FIG. 6 is a time chart of an upstream side output air-fuel ratio and downstream side output air-fuel ratio etc. before and after fuel cut control.

FIG. 6 is a time chart similar to FIG. 5 of the upstream side output air-fuel ratio and downstream side output air-fuel ratio before and after fuel cut control. In the illustrated example, fuel cut control is started at the time $t_1$ and fuel cut control is ended at the time $t_3$. If fuel cut control is ended, due to post reset rich control, rich air-fuel ratio exhaust gas is made to flow into the upstream side exhaust purification catalyst 20.

If the downstream side air-fuel ratio sensor 41 does not suffer from deterioration of response, the output air-fuel ratio of the downstream side air-fuel ratio sensor 41 follows a trend as shown in FIG. 6 by the solid line A. That is, after the end of fuel cut control, since there is distance between the engine body 1 to the downstream side air-fuel ratio sensor 41, the output air-fuel ratio of the downstream side air-fuel ratio sensor 41 starts to fall while delayed slightly from the end of fuel cut control. Further, at this time, the air-fuel ratio of the exhaust gas flowing out from the upstream side exhaust purification catalyst 20 becomes substantially the stoichiometric air-fuel ratio, and therefore the output air-fuel ratio of the downstream side air-fuel ratio sensor 41 also converges to substantially the stoichiometric air-fuel ratio.

On the other hand, if the downstream side air-fuel ratio sensor 41 suffers from the deterioration of response, the output air-fuel ratio of the downstream side air-fuel ratio sensor 41 follows a trend as shown in FIG. 6 by the broken line B. That is, compared with when the downstream side air-fuel ratio sensor 41 does not suffer from deterioration of response (solid line A), the speed of fall of the output air-fuel ratio becomes slower. In this way, the speed of fall of the output air-fuel ratio of the downstream side air-fuel ratio sensor 41 changes in accordance with any deterioration of response of the downstream side air-fuel ratio sensor 41. For this reason, by calculating this speed of fall, the presence of any deterioration of response of the downstream side air-fuel ratio sensor 41 can be diagnosed. In particular, such deterioration of response is preferably diagnosed based on the speed of fall in the region where the exhaust air-fuel ratio is between 18 or so and 17 or so.

In this regard, the trend in the output air-fuel ratio of the downstream side air-fuel ratio sensor 41 after the end of fuel cut control also changes according to the degree of deterioration of the upstream side exhaust purification catalyst 20. For example, if the degree of deterioration of the upstream side exhaust purification catalyst 20 is high and the oxygen storage ability falls, the upstream side exhaust purification catalyst 20 does not store almost any oxygen even during fuel cut control. For this reason, if fuel cut control ends and the air-fuel ratio of the exhaust gas flowing into the upstream side exhaust purification catalyst 20 is made the rich air-fuel ratio, along with this, the air-fuel ratio of the exhaust gas flowing out from the upstream side exhaust purification catalyst 20 also rapidly falls.

This state is shown in FIG. 6 by the one-dot chain line C. In FIG. 6, the one-dot chain line C expresses the trend in the output air-fuel ratio in the case where the downstream side air-fuel ratio sensor 41 does not suffer from deterioration of response and the degree of deterioration of the upstream side exhaust purification catalyst 20 is high. As will be understood from a comparison of the solid line A and one-dot chain line C of FIG. 6, after the end of fuel cut control, the speed of change of the output air-fuel ratio of the downstream side air-fuel ratio sensor 41 becomes faster than the case where the upstream side exhaust purification catalyst 20 has not deteriorated.

On the other hand, if the downstream side air-fuel ratio sensor 41 suffers from deterioration of response and the degree of deterioration of the upstream side exhaust purification catalyst 20 is high, the decrease in the speed of fall of the output air-fuel ratio accompanying deterioration of response and the increase in the speed of fall of the output air-fuel ratio accompanying deterioration of the upstream side exhaust purification catalyst 20 are matched. As a result, in such a case, the output air-fuel ratio of the downstream side air-fuel ratio sensor 41, as shown in FIG. 6 by the two-dot chain line D, follows the same trend as the output air-fuel ratio in the case of the solid line A (case where downstream side air-fuel ratio sensor 41 does not suffer from deterioration of response and degree of deterioration of the upstream side exhaust purification catalyst 20 is low) in the region of the exhaust air-fuel ratio between 18 or so and 17 or so.

For this reason, if, as explained above, the speed of fall of the output air-fuel ratio is used as the basis for diagnosing deterioration of response, as shown in FIG. 6 by the two-dot chain line D, it is not possible to judge abnormality regardless of the downstream side air-fuel ratio sensor 41 suffering from the abnormality of deterioration of response.

<Principle of Diagnosis of Abnormality in Present Invention>

As opposed to this, in an embodiment according to the present invention, in two different air-fuel ratio regions, the speeds of change of the output air-fuel ratio of the downstream side air-fuel ratio sensor 41 in those air-fuel ratio regions are calculated, and based on the calculated speeds of change at the air-fuel ratio regions, abnormality of the downstream side air-fuel ratio sensor 41 (in particular, deterioration of response) is diagnosed. First, the principle of diagnosis of abnormality of the downstream side air-fuel ratio sensor 41 in the present invention will be explained below.

As explained above, in the region between output air-fuel ratios of about 18 and about 17, so long as the degree of deterioration of the upstream side exhaust purification catalyst 20 is low, it is possible to detect the presence or absence of deterioration of response of the output air-fuel ratio of the downstream side air-fuel ratio sensor 41. Therefore, in the present embodiment, after the end of fuel cut control, the speed of decrease of the output air-fuel ratio at the time the output air-fuel ratio of the downstream side air-fuel ratio sensor 41 first passes through a first air-fuel ratio region X between 18 and 17 (below, referred to as "the first change of speed of air-fuel ratio") is calculated. The time period $\Delta T_1$ from when changing from the upper limit air-fuel ratio of the first air-fuel ratio region (that is, 18) to the lower limit air-fuel ratio of the first air-fuel ratio region (that is, 17) is used as a parameter expressing the first change of speed of air-fuel ratio. The longer this first time period of change of the air-fuel ratio $\Delta T_1$, the slower the first change of speed of air-fuel ratio becomes. Note that, in FIG. 1, the first time period of change of the air-fuel ratio $\Delta T_1$ is a parameter showing the first change of speed of air-fuel ratio regarding the solid line A.

In addition, in the present embodiment, the speed of change of the output air-fuel ratio at the time the output air-fuel ratio of the downstream side air-fuel ratio sensor 41 is in a second air-fuel ratio region Y between 16 and the stoichiometric air-fuel ratio (14.6) (below, referred to as "second change of speed of air-fuel ratio") is calculated. Regarding this second change of speed of air-fuel ratio as well, in the same way as the first change of speed of air-fuel ratio, the time period $\Delta T_2$ from when changing from the upper limit air-fuel ratio of the second air-fuel ratio region (i.e., 16) to the lower limit air-fuel ratio of the second air-fuel ratio region (i.e., the stoichiometric air-fuel ratio) is used as a parameter expressing the second change of speed of air-fuel ratio. The longer this second time period of change of the air-fuel ratio $\Delta T_2$ as well, the slower the second change of speed of air-fuel ratio becomes. Note that, in FIG. 1, the second time period of change of the air-fuel ratio $\Delta T_2$ is a parameter showing the first change of speed of air-fuel ratio regarding the solid line A.

According to this embodiment of the present invention, based on the thus calculated first speed of change of air-fuel ratio and second speed of change of air-fuel ratio are used as the basis, abnormality of the downstream side air-fuel ratio sensor 41 is diagnosed. First, if the first speed of change of air-fuel ratio (speed of change at first air-fuel ratio region X) is slower than a speed of change used as reference for abnormality (that is, the time period $\Delta T_1$ is longer than the threshold value used as reference for abnormality), it is judged that the downstream side air-fuel ratio sensor 41 suffers from the abnormality of deterioration of response.

That is, if comparing the output air-fuel ratios A to D in the first air-fuel ratio region X, the slope becomes smaller at the broken line B compared with the solid line where the downstream side air-fuel ratio sensor 41 does not suffering from deterioration of response and the degree of deterioration of the upstream side exhaust purification catalyst 20 is low. Further, the broken line B shows the case where the downstream side air-fuel ratio sensor 41 suffers from deterioration of response. Therefore, if the first speed of change of air-fuel ratio becomes slower than the speed of change of air-fuel ratio when the downstream side air-fuel ratio sensor 41 does not suffer from deterioration of response, it can be said that the downstream side air-fuel ratio sensor 41 is suffering from the abnormality of deterioration of response. Therefore, in the present embodiment, when the speed of change of the output air-fuel ratio of the downstream side air-fuel ratio sensor 41 is slower than the speed of change used as reference for abnormality, it is judged that the downstream side air-fuel ratio sensor 41 suffers from the abnormality of deterioration of response.

It should be noted that the speed of change used as reference for abnormality, for example, is made a slightly slower speed than the minimum speed which the speed of change can take in the first air-fuel ratio region X when the downstream side air-fuel ratio sensor 41 does not suffer from deterioration of response and the degree of deterioration of the upstream side exhaust purification catalyst 20 is low. Further, the speed of change used as reference for abnormality may be a predetermined value and may be a value which changes in accordance with the engine speed or engine load or other operating parameter in post-reset rich control.

On the other hand, when the first speed of change of air-fuel ratio (speed of change in first air-fuel ratio region X) is faster than the speed of change used as reference for normality (i.e. the time period $\Delta T_1$ is shorter than the threshold value used as reference for normality), it is judged that the downstream side air-fuel ratio sensor 41 suffers from the abnormality of deterioration of response. In other words, if the output air-fuel ratios A to D in the first air-fuel ratio region X are compared, the slope becomes larger at the one-dot chain line C compared with the solid line A where the downstream side air-fuel ratio sensor 41 does not suffered from deterioration of response and the degree of deterioration of the upstream side exhaust purification catalyst 20 is low. Further, the one-dot chain line C shows the case where the downstream side air-fuel ratio sensor 41 does not suffer from deterioration of response. Therefore, if the first speed of change of air-fuel ratio becomes faster than the speed of change of air-fuel ratio when the downstream side air-fuel ratio sensor 41 suffers from deterioration of response, it can be said that the downstream side air-fuel ratio sensor 41 does not suffer from the abnormality of deterioration of response. Therefore, in the present embodiment, when the speed of change of the output air-fuel ratio of the downstream side air-fuel ratio sensor 41 is faster than the speed of change used as reference for normality, it is judged that downstream side air-fuel ratio sensor 41 does not suffer from the abnormality of deterioration of response.

It should be noted that the speed of change used as reference for normality is, for example, made a speed of change slightly faster than the maximum speed which the speed of change can take in the first air-fuel ratio region X when the downstream side air-fuel ratio sensor 41 does not suffer from deterioration of response and the degree of deterioration of the upstream side exhaust purification catalyst 20 is low. Further, the speed of change used as reference for normality may also be a predetermined value or may be a value which changes in accordance with the engine speed, engine load, or other operating parameter during post-reset rich control.

As opposed to this, when the first speed of change of air-fuel ratio (speed of change in first air-fuel ratio region X) is faster than the speed of change used as reference for abnormality and is slower than the speed of change used as reference for normality, it is judged that it is unclear whether the downstream side air-fuel ratio sensor 41 suffers from the abnormality of deterioration of response (state of abnormality unclear) and that a hold should be put on judgment. In other words, as explained above, in the first air-fuel ratio region X, both when the downstream side air-fuel ratio sensor 41 does not suffer from the abnormality of deterioration of response and the degree of deterioration of the upstream side exhaust purification catalyst 20 is low (solid line A) and when the downstream side air-fuel ratio sensor 41 suffers from the abnormality of deterioration of response and the degree of deterioration of the upstream side exhaust purification catalyst 20 is high (two-dot chain line D), the output air-fuel ratio of the downstream side air-fuel ratio sensor 41 exhibits similar trends. Therefore, in both cases, the first speed of change of air-fuel ratio ends up becoming faster than the speed of change used as reference for abnormality and becoming slower than the speed of change used as reference for normality. Therefore, in the present embodiment, when the speed of change of the output air-fuel ratio of the downstream side air-fuel ratio sensor 41 is faster than the speed of change used as reference for abnormality and slower than the speed of change used as reference for normality, it is judged that a hold should be put on judgment.

On the other hand, the solid line A and the two-dot chain line D at which they are judged that a hold should be put on judgment based on the first speed of change of air-fuel ratio are compared. In the case of the solid line A (when downstream side air-fuel ratio sensor 41 does not suffer from abnormality of deterioration of response and degree of deterioration of upstream side exhaust purification catalyst 20 is also low), the output air-fuel ratio of the downstream side air-fuel ratio sensor 41 gradually converges to the stoichiometric air-fuel ratio. This is because the degree of deterioration of the upstream side exhaust purification catalyst 20 is low, and therefore even if the air-fuel ratio of the exhaust gas flowing into the upstream side exhaust purification catalyst 20 is a rich air-fuel ratio, the oxygen stored in the upstream side exhaust purification catalyst 20 enables the unburned gas to be removed by oxidation. As a result, in the case of the solid line A, the second speed of change of air-fuel ratio (speed of change in second air-fuel ratio region Y) becomes slower.

On the other hand, in the case of the two-dot chain line B (when the downstream side air-fuel ratio sensor 41 suffers from the abnormality of deterioration of response and the degree of deterioration of the upstream side exhaust purification catalyst 20 is high), the output air-fuel ratio of the downstream side air-fuel ratio sensor 41 changes quickly over the stoichiometric air-fuel ratio until the rich air-fuel ratio. This is because the degree of deterioration of the upstream side exhaust purification catalyst 20 is high, and therefore the upstream side exhaust purification catalyst 20 no longer stores much oxygen and as a result, the exhaust gas flowing into the upstream side exhaust purification catalyst 20 passes through the upstream side exhaust purification catalyst 20 as is. Therefore, in the case of the two-dot chain line D, the second speed of change of air-fuel ratio (speed of change in second air-fuel ratio region Y) becomes faster.

It should be noted that in the example shown in FIG. 6, in the one-dot chain line C and the two-dot chain line D, the output air-fuel ratio of the downstream side air-fuel ratio sensor 41 changes to the rich air-fuel ratio, then immediately changes to the stoichiometric air-fuel ratio. This is because right after the output air-fuel ratio changes to the rich air-fuel ratio (more accurately, right after the end judgment air-fuel ratio is reached), the post-reset rich control is ended and the target air-fuel ratio of the exhaust gas flowing into the upstream side exhaust purification catalyst 20 is switched to the stoichiometric air-fuel ratio.

Therefore, in the present embodiment, if it is judged that a hold should be put on judgment in the judgment based on the first speed of change of air-fuel ratio, abnormality of the downstream side air-fuel ratio sensor 41 is diagnosed based on the second speed of change of air-fuel ratio. Specifically, when the second speed of change of air-fuel ratio is slower than the speed of change used as reference for judgment of normality and abnormality, it is judged that the downstream side air-fuel ratio sensor 41 does not suffer from the abnormality of deterioration of response. On the other hand, when the second speed of change of air-fuel ratio is faster than the speed of change used as reference for judgment of normality and abnormality, it is judged that the downstream side air-fuel ratio sensor 41 suffers from the abnormality of deterioration of response. It should be noted that the speed of change used as reference for judgment of normality and abnormality is, for example, a speed of change slightly faster than the maximum speed which the speed of change can take in the second air-fuel ratio region Y when the downstream side air-fuel ratio sensor 41 does not suffer from deterioration of response and the degree of deterioration of the upstream side exhaust purification catalyst 20 is low. Further, the speed of change used as reference for judgment of normality and abnormality may be a predetermined value and may be a value which changes in accordance with the engine speed or engine load or other operating parameter in post-reset rich control.

Therefore, if combining these, in the present embodiment, when the first speed of change of air-fuel ratio is slower than the speed of change used as reference for abnormality, it is judged that the downstream side air-fuel ratio sensor 41 is abnormal, while when the first speed of change of air-fuel ratio is faster than the speed of change used as reference for normality, it is judged that the downstream side air-fuel ratio sensor 41 is normal. Further, if the first speed of change of air-fuel ratio is faster than the speed of change used as reference for abnormality and is slower than the speed of change used as reference for normality, it is judged that a hold should be put on judgment (that is, the state of abnormality is unclear). Further, if it is judged based on the first speed of change of air-fuel ratio that a hold should be put on judgment, when the second speed of change of air-fuel ratio is slower than the speed of change used as reference for judgment of normality and abnormality, it is judged that the downstream side air-fuel ratio sensor 41 is normal, while when it is faster than the speed of change used as reference for judgment of normality and abnormality, it is judged that the downstream side air-fuel ratio sensor 41 is abnormal. By diagnosing abnormality of the downstream side air-fuel ratio sensor 41 in this way, even if the upstream side exhaust purification catalyst 20 deteriorates, it becomes possible to accurately diagnose the abnormality of deterioration of response of the downstream side air-fuel ratio sensor 41.

It should be noted that the calculation of the first speed of change of air-fuel ratio based on the output air-fuel ratio of the downstream side air-fuel ratio sensor 41 is performed by the first change speed calculating means, while the calculation of the second speed of change of air-fuel ratio based on the output air-fuel ratio of the downstream side air-fuel ratio sensor 41 is performed by the second change speed calculating means. Further, the judgment of normality and abnormality of the downstream side air-fuel ratio sensor 41 based on the first speed of change of air-fuel ratio and second speed of change of air-fuel ratio is performed by the abnormality diagnosing means. The ECU 31 functions as these first change speed calculating means, second change speed calculating means, and abnormality diagnosing means.

Further, in the above embodiment, as the speeds of change of air-fuel ratio when passing through the air-fuel ratio regions X and Y, the time periods when the output air-fuel ratio of the downstream side air-fuel ratio sensor 41 changes from the upper limit air-fuel ratio to the lower limit air-fuel ratio of the air-fuel ratio regions (time periods of change of the air-fuel ratio) are used. However, instead of the time periods of change of the air-fuel ratio, the values obtained by subtracting from the upper limit air-fuel ratios of the output air-fuel ratio the lower limit air-fuel ratios of the air-fuel ratio regions and dividing those values by the time period of change of the air-fuel ratio may also be made the speeds of change of air-fuel ratio.

Alternatively, instead of the speeds of change of air-fuel ratio when passing through the air-fuel ratio regions X and Y, it is also possible to use the cumulative values of amount of exhaust gas passing through the downstream side air-fuel ratio sensor 41 in the periods from when the output air-fuel ratios change from the upper limit air-fuel ratios to the lower limit air-fuel ratios of the air-fuel ratio regions. The cumulative values of amount of exhaust gas may be estimated from the output value of the air flowmeter 39 or may be estimated from the engine load and engine speed.

In this case, when the first cumulative value of amount of exhaust gas obtained by cumulatively adding the amount of exhaust gas passing through the downstream side air-fuel ratio sensor 41 in the period during which the output air-fuel ratio changes from the upper limit air-fuel ratio to the lower limit air-fuel ratio of the first air-fuel ratio region is larger than the cumulative value used as reference for abnormality, it is judged that the downstream side air-fuel ratio sensor 41 is abnormal. On the other hand, when the first cumulative value of amount of exhaust gas is smaller than the cumulative value used as reference for normality, it is judged that the downstream side air-fuel ratio sensor 41 is normal, while when the first cumulative value of amount of exhaust gas is between the cumulative value used as reference for abnormality and the cumulative value used as reference for normality, it is judged that a hold should be put on judgment. Further, if it is judged that a hold should be put on judgment based on the first cumulative value of amount of exhaust gas, when the second cumulative value of amount of exhaust gas obtained by cumulatively adding the amount of exhaust gas passing through the downstream side air-fuel ratio sensor 41 in the period during which the output air-fuel ratio changes from the upper limit air-fuel ratio to the lower limit air-fuel ratio of the second air-fuel ratio region is larger than the cumulative value used as reference for judgment of normality and abnormality, it is judged that the downstream side air-fuel ratio sensor is normal. On the other hand, if the second cumulative value of amount of exhaust gas is smaller than the cumulative value used as reference for judgment of normality and abnormality, it is judged that the downstream side air-fuel ratio sensor 41 is abnormal.

Further, in the present embodiment, when the diagnosis system judges that the downstream side air-fuel ratio sensor 41 is abnormal, a warning light is lit in the vehicle mounting the internal combustion engine.

In addition, as explained above, in the case of the one-dot chain line C and the case of the two-dot chain line D, the degree of deterioration of the upstream side exhaust purification catalyst 20 is high. Therefore, in these cases, it may be judged that the upstream side exhaust purification catalyst 20 is deteriorating. Specifically, when the first speed of change of air-fuel ratio is faster than the speed of change used as reference for normality, i.e. when it is judged based on the first speed of change of air-fuel ratio that the downstream side air-fuel ratio sensor 41 is normal, it is judged that the upstream side exhaust purification catalyst 20 is deteriorating. Further, when the second speed of change of air-fuel ratio is faster than the speed of change used as reference for judgment of normality and abnormality, i.e. when it is judged based on the second speed of change of air-fuel ratio that the downstream side air-fuel ratio sensor 41 is abnormal, it is judged that the upstream side exhaust purification catalyst 20 is deteriorating.

<First Air-Fuel Ratio Region and Second Air-Fuel Ratio Region>

In this regard, if making the first air-fuel ratio region a region between the first region upper limit air-fuel ratio and the first region lower limit air-fuel ratio at the richer side than this, in the above-mentioned example, the first region upper limit air-fuel ratio is made 18, while the first region lower limit air-fuel ratio is made 17. Further, if making the second air-fuel ratio region a region between the second region upper limit air-fuel ratio and the second region lower limit air-fuel ratio at the richer side than this, in the above-mentioned example, the second region upper limit air-fuel ratio is made 16 and the second region lower limit air-fuel ratio is made the stoichiometric air-fuel ratio (in the above-mentioned example, 14.6). However, this should be changed in accordance with the characteristic of the exhaust purification catalyst 20, composition of the fuel, configuration of the downstream side air-fuel ratio sensor 41, etc., and therefore the first air-fuel ratio region and the second air-fuel ratio region do not necessarily have to be regions between these.

First, the first air-fuel ratio region will be explained. The first air-fuel ratio region basically has to be a region in which the speed of change of the output air-fuel ratio changes when the downstream side air-fuel ratio sensor 41 suffers from deterioration of response. Therefore, the first region upper limit air-fuel ratio has to be lower than the output air-fuel ratio when air is discharged from the upstream side exhaust purification catalyst 20.

In addition, when using as the downstream side air-fuel ratio sensor 41 a limit current type air-fuel ratio sensor as explained above, the first region upper limit air-fuel ratio has to be an air-fuel ratio at which the downstream side air-fuel ratio sensor 41 can generate a limit current. For example, in the example shown in FIG. 3, when the applied voltage at the downstream side air-fuel ratio sensor 41 is made 0.4V, if the exhaust air-fuel ratio is 18 or so, the limit current is output, but if the exhaust air-fuel ratio becomes more than this, the limit current is not output. If in this way the limit current is no longer output, the precision of the output current with respect to the actual air-fuel ratio deteriorates, and therefore the precision of detection of the air-fuel ratio falls. Therefore, the first region upper limit air-fuel ratio is made an air-fuel ratio at which the downstream side air-fuel ratio sensor 41 can generate a limit current. At an air-fuel ratio sensor having the V-I characteristic shown in FIG. 3, it is made 18 or less.

Alternatively, in the case of using as the downstream side air-fuel ratio sensor 41 a sensor configured so that the applied voltage is made larger as the output current increases, the first region upper limit air-fuel ratio may also be used as the upper limit lean air-fuel ratio at which limit current is generated when applying a voltage at which limit current is generated when detecting exhaust gas corresponding to the stoichiometric air-fuel ratio.

Further, the timing at which the air-fuel ratio of the exhaust gas flowing out from the upstream side exhaust purification catalyst 20 becomes richer than the stoichiometric air-fuel ratio changes according to the amount of oxygen which can be stored by the upstream side exhaust purification catalyst 20 (maximum oxygen storage amount). Therefore, if setting the first region lower limit air-fuel ratio lower than the stoichiometric air-fuel ratio, even if the deterioration of response of the downstream side air-fuel ratio sensor 41 is of the same extent, the timing changes depending on the maximum oxygen storage amount of the upstream side exhaust purification catalyst 20. Therefore, the first region lower limit air-fuel ratio has to be the stoichiometric air-fuel ratio or more. In particular, the first region lower limit air-fuel ratio is preferably leaner than the stoichiometric air-fuel ratio.

In addition, when using the limit current type air-fuel ratio sensor as the downstream side air-fuel ratio sensor 41 in the above way, the first region lower limit air-fuel ratio also has to be an air-fuel ratio at which the downstream side air-fuel ratio sensor 41 can generate a limit current. Therefore, in an air-fuel ratio sensor having the V-I characteristic shown in FIG. 3, it is made 12 or more. It should be noted that, considering the point that both the first region upper limit air-fuel ratio and the first region lower limit air-fuel ratio have to be air-fuel ratios at which the downstream side air-fuel ratio sensor 41 can generate the limit current, the first air-fuel ratio region can be said to be a region in the air-fuel ratio region where the downstream side air-fuel ratio sensor 41 generates a limit current.

Next, the second air-fuel ratio region will be explained. The second air-fuel ratio region basically has to be a region in which the speed of change of the output air-fuel ratio changes in accordance with the degree of deterioration of the upstream side exhaust purification catalyst 20 regardless of the presence or absence of deterioration of response of the downstream side air-fuel ratio sensor 41. As explained above, the output air-fuel ratio near the stoichiometric air-fuel ratio changes in accordance with the degree of deterioration of the upstream side exhaust purification catalyst 20, and therefore the second air-fuel ratio region preferably includes the region near the stoichiometric air-fuel ratio.

In the same way as the above-mentioned first region upper limit air-fuel ratio, the second region upper limit air-fuel ratio has to be lower than the output air-fuel ratio when the upstream side exhaust purification catalyst 20 discharges air. In addition, when using a limit current type air-fuel ratio sensor as the downstream side air-fuel ratio sensor 41, the second region air-fuel ratio has to be an air-fuel ratio at which the downstream side air-fuel ratio sensor 41 can generate a limit current. Furthermore, to prevent the second change of speed of air-fuel ratio from being affected by the change of speed of air-fuel ratio in the first air-fuel ratio region, the second region upper limit air-fuel ratio is preferably richer (lower) than the first region lower limit air-fuel ratio.

On the other hand, the second region lower limit air-fuel ratio, as explained above, is made an air-fuel ratio so that the second air-fuel ratio region includes the vicinity of the stoichiometric air-fuel ratio since the trend in the output air-fuel ratio in the vicinity of the stoichiometric air-fuel ratio changes in accordance with the degree of deterioration of the upstream side exhaust purification catalyst 20. Specifically, the second region lower limit air-fuel ratio is made inside the range from an air-fuel ratio slightly leaner than the stoichiometric air-fuel ratio to an air-fuel ratio richer than the stoichiometric air-fuel ratio. Further, if the timing of end of post-reset rich control is made the time when the output air-fuel ratio of the downstream side air-fuel ratio sensor 41 reaches the end judgment air-fuel ratio richer than the stoichiometric air-fuel ratio, the end judgment air-fuel ratio may also be made the second region lower limit air-fuel ratio. Further, when using a downstream side air-fuel ratio sensor 41 constituted by a limit current type air-fuel ratio sensor as explained above, the second air-fuel ratio region is also made a region in the air-fuel ratio region where the downstream side air-fuel ratio sensor 41 can generate a limit current.

It should be noted that in the case of generally explaining the relationship between the first air-fuel ratio region and the second air-fuel ratio region, in the present embodiment, it can be said that the first air-fuel ratio region preferably includes an air-fuel ratio region leaner than the second air-fuel ratio region, while the second air-fuel ratio region preferably includes an air-fuel ratio region richer than the first air-fuel ratio region.

<Flow Chart>

Figure 8:
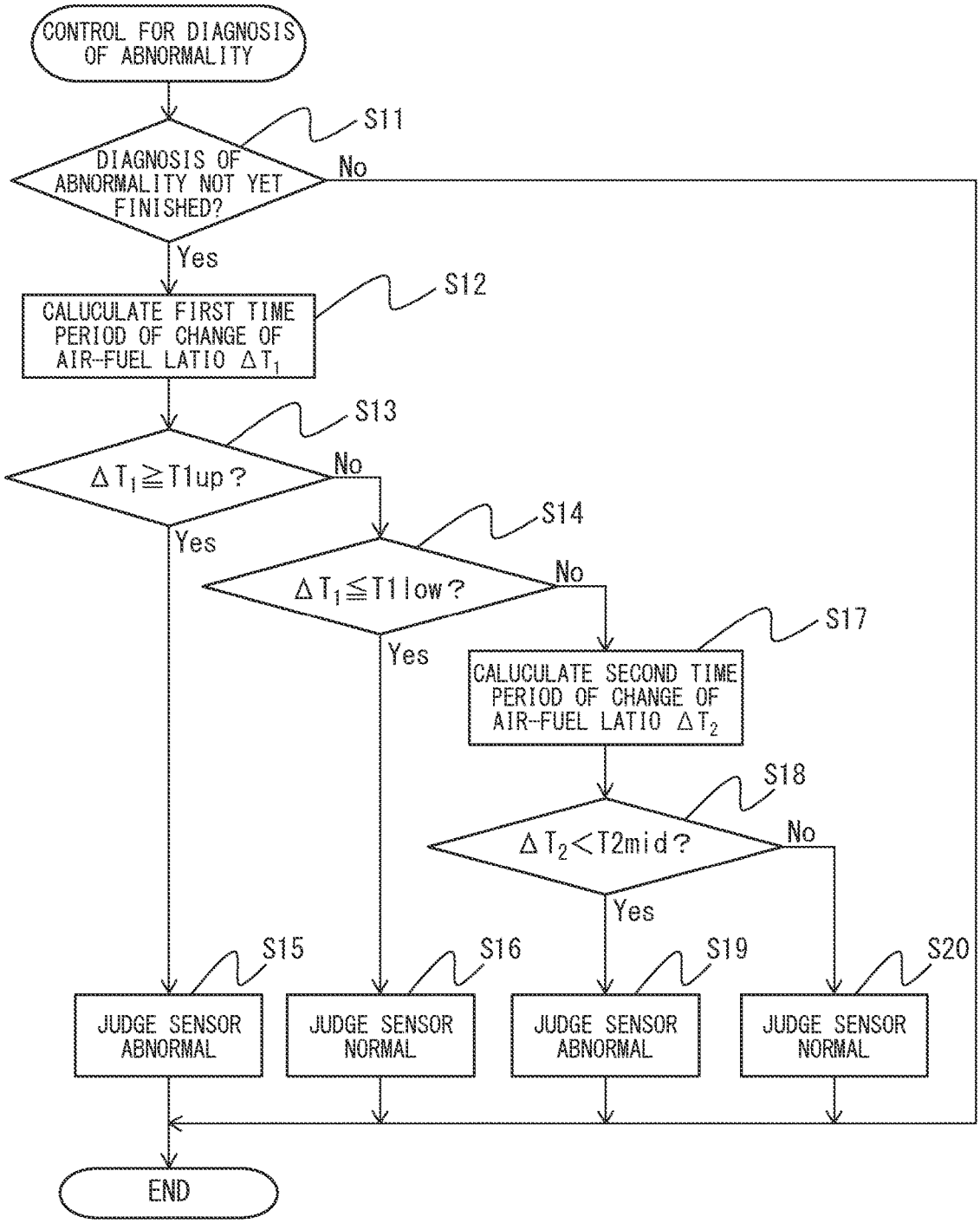
FIG. 8 is a flow chart showing a control routine of control for diagnosis of abnormality in the first embodiment.

FIG. 8 is a flow chart showing a control routine of control for diagnosing abnormality in the present embodiment. The control for diagnosis of abnormality shown in FIG. 8 is performed at the ECU 31.

As shown in FIG. 8, first, at step S11, it is judged if the downstream side air-fuel ratio sensor 41 was already diagnosed for abnormality after the internal combustion engine was started or after the ignition key of the vehicle mounting the internal combustion engine was turned on. If at step S11 it is judged that it was already diagnosed for abnormality, the control routine is made to end. On the other hand, if it is judged at step S11 that the downstream side air-fuel ratio sensor 41 has not yet finished being diagnosed for abnormality, the routine proceeds to step S12.

At step S12, based on the output of the downstream side air-fuel ratio sensor 41, the first time period of change of the air-fuel ratio $\Delta T_1$ is calculated. Specifically, after the end of fuel cut control and the start of post-reset rich control, the time period from when the output air-fuel ratio of the downstream side air-fuel ratio sensor 41 first reaches the first region upper limit air-fuel ratio (for example, 18) to when it first reaches the first region lower limit air-fuel ratio (for example, 17) is calculated as the first time period of change of the air-fuel ratio $\Delta T_1$.

Next, at steps S13 and S14, it is judged if the first time period of change of the air-fuel ratio $\Delta T_1$ calculated at step S12 is the threshold value used for judgment of abnormality T1up or more, the threshold value used for judgment of normality T1low or less, or between the threshold value used for judgment of abnormality T1up and the threshold value used for judgment of normality T1low. When it is judged that the first time period of change of the air-fuel ratio $\Delta T_1$ is the threshold value used for judgment of abnormality T1up or more, the routine proceeds to step S15. At step S15, it is judged that the downstream side air-fuel ratio sensor 41 suffers from the abnormality of deterioration of response. On the other hand, when at steps S13 and S14 it is judged that the first time period of change of the air-fuel ratio $\Delta T_1$ is the threshold value used for judgment of normality T1low or less, the routine proceeds to step S16. At step S16, it is judged that the downstream side air-fuel ratio sensor 41 does not suffer from the abnormality of deterioration of response. On the other hand, when at steps S13 and S14, it is judged the first time period of change of the air-fuel ratio $\Delta T_1$ is between the threshold value used for judgment of abnormality T1up and the threshold value used for judgment of normality T1low, the routine proceeds to step S17.

At step S17, based on the output of the downstream side air-fuel ratio sensor 41, the second time period of change of the air-fuel ratio $\Delta T_2$ is calculated. Specifically, after the end of fuel cut control and the start of post-reset rich control, the time period from when the output air-fuel ratio of the downstream side air-fuel ratio sensor 41 first reaches the second region upper limit air-fuel ratio (for example, 16) to when it first reaches the second region lower limit air-fuel ratio (for example, stoichiometric air-fuel ratio) is calculated as the second time period of change of the air-fuel ratio $\Delta T_2$.

Next, at step S18, it is judged if the second time period of change of the air-fuel ratio $\Delta T_2$ calculated at step S17 is smaller than the threshold value used for judgment of normality and abnormality T2mid. When it is judged that the second time period of change of the air-fuel ratio $\Delta T_2$ is smaller than the threshold value used for judgment of normality and abnormality T2mid, the routine proceeds to step S19. At step S19, it is judged that the downstream side air-fuel ratio sensor 41 suffers from the abnormality of deterioration of response. On the other hand, when at step S18 it is judged that the second time period of change of the air-fuel ratio $\Delta T_2$ is the threshold value used for judgment of normality and abnormality T2mid or more, the routine proceeds to step S20. At step S20, it is judged that the downstream side air-fuel ratio sensor 41 does not suffer from the abnormality of deterioration of response.

It should be noted that in the above example, abnormality is diagnosed based on the first time period of change of the air-fuel ratio $\Delta T_1$ and the second time period of change of the air-fuel ratio $\Delta T_2$. However, as explained above, instead of the first time period of change of the air-fuel ratio $\Delta T_1$, it is also possible to use the first speed of change of air-fuel ratio $V_1$ obtained by subtracting from the first region upper limit air-fuel ratio the first region lower limit air-fuel ratio and dividing the value by the first time period of change of the air-fuel ratio. Further, instead of the second time period of change of the air-fuel ratio $\Delta T_2$, it is also possible to use the second speed of change of air-fuel ratio $V_2$ obtained by subtracting from the second region upper limit air-fuel ratio the second region lower limit air-fuel ratio and dividing the value by the second time period of change of the air-fuel ratio.

Alternatively, as explained above, instead of the first time period of change of the air-fuel ratio $\Delta T_1$, it is also possible to use the cumulative value of the first amount of exhaust gas obtained by cumulatively adding the amount of exhaust gas passing through the downstream side air-fuel ratio sensor 41 while the output air-fuel ratio changes from the first region upper limit air-fuel ratio to the first region lower limit air-fuel ratio. Further, instead of the second time period of change of the air-fuel ratio $\Delta T_2$, it is also possible to use the cumulative value of the second amount of exhaust gas obtained by cumulatively adding the amount of exhaust gas passing through the downstream side air-fuel ratio sensor 41 while the output air-fuel ratio changes from the second region upper limit air-fuel ratio to the second region lower limit air-fuel ratio.

In this case, when at step S13 the first speed of change of air-fuel ratio $V_1$ is the speed of change used as reference for abnormality or less, the routine proceeds to step S15 where it is judged that the downstream side air-fuel ratio sensor 41 is abnormal. Further, when at step S14 the first speed of change of air-fuel ratio $V_1$ is the speed of change used as reference for normality or more, the routine proceeds to step S16 where it is judged that the downstream side air-fuel ratio sensor 41 is not abnormal. In the same way, when at step S18 the second speed of change of air-fuel ratio $V_2$ is the speed of change used as reference for normality and abnormality or more, the routine proceeds to step S19 where it is judged that the downstream side air-fuel ratio sensor 41 is abnormal.

Second Embodiment

Next, referring to FIG. 9, a diagnosis system according to a second embodiment of the present invention will be explained. The diagnosis system according to the second embodiment basically is configured in the same way as the diagnosis system according to the first embodiment. However, in the first embodiment, the speed of change of the output air-fuel ratio of the downstream side air-fuel ratio sensor 41 is used as the basis to diagnose abnormality, while in the second embodiment, a cumulative value (integrated value) of the output air-fuel ratio of the downstream side air-fuel ratio sensor 41 is used as the basis to diagnose abnormality.

For the presence or absence of deterioration of response of the output air-fuel ratio of the downstream side air-fuel ratio sensor 41, the cumulative value of the output air-fuel ratio also exhibits a similar trend as the speed of change of the air-fuel ratio. This state is shown in FIG. 9.

Figure 7:
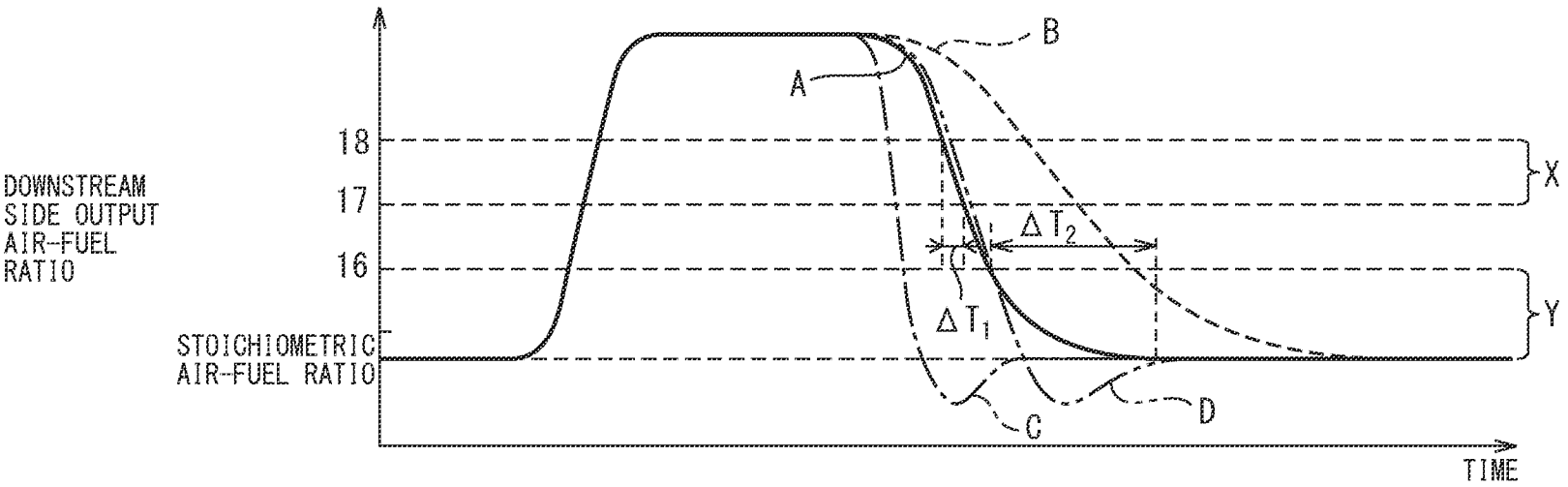
FIG. 7 is a time chart of a downstream side output air-fuel ratio before and after fuel cut control.
Figure 9:
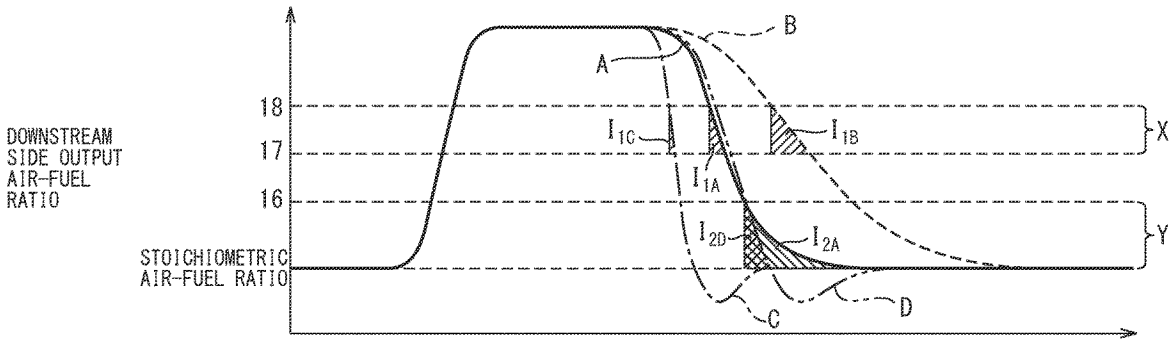
FIG. 9 is a time chart of a downstream side output air-fuel ratio before and after fuel cut control.

FIG. 9 is a time chart similar to FIG. 7. In FIG. 9, $I_{1A}$ is the cumulative value of the output air-fuel ratio at the time the output air-fuel ratio first passes through the first air-fuel ratio region X in the case where the downstream side air-fuel ratio sensor 41 does not suffer from deterioration of response and the degree of deterioration of the upstream side exhaust purification catalyst 20 is low (solid line A). Further, in FIG. 9, $I_{1B}$ is the cumulative value of the output air-fuel ratio at the time the output air-fuel ratio first passes through the first air-fuel ratio region X in the case where the downstream side air-fuel ratio sensor 41 suffers from deterioration of response and the degree of deterioration of the upstream side exhaust purification catalyst 20 is low (solid line B). Furthermore, in FIG. 9, $I_{1C}$ is the cumulative value of the output air-fuel ratio at the time the output air-fuel ratio first passes through the first air-fuel ratio region X in the case where the downstream side air-fuel ratio sensor 41 does not suffer from deterioration of response and the degree of deterioration of the upstream side exhaust purification catalyst 20 is high (solid line C).

If comparing these cumulative values $I_{1A}$, $I_{1B}$, and $I_{1C}$, the cumulative value $I_{1B}$ is larger than the cumulative value $I_{1A}$. Therefore, it is understood that if the downstream side air-fuel ratio sensor 41 suffers from deterioration of response, the cumulative value of the output air-fuel ratio when passing through the first air-fuel ratio region X becomes larger. Further, the cumulative value $I_{1C}$ is smaller than the cumulative value $I_{1A}$. Therefore, if the degree of deterioration of the upstream side exhaust purification catalyst 20 becomes higher, the cumulative value of the output air-fuel ratio at the time of passing through the first air-fuel ratio region X becomes smaller.

On the other hand, when the downstream side air-fuel ratio sensor 41 does not suffer from deterioration of response and the degree of deterioration of the upstream side exhaust purification catalyst 20 is low (two-dot chain line D), the output air-fuel ratio exhibits behavior similar to the solid line A in the first air-fuel ratio region X. For this reason, in a case such as shown by the solid line A and in a case such as shown by the two-dot chain line D, the cumulative values of the output air-fuel ratios at the time the output air-fuel ratios first pass through the first air-fuel ratio region X become the same extent.

Therefore, in the present embodiment, if the cumulative value of the output air-fuel ratio when the output air-fuel ratio first passes through the first air-fuel ratio region X is larger than the cumulative value used as reference for abnormality, it is judged that the downstream side air-fuel ratio sensor 41 suffers from the abnormality of deterioration of response. Note that, the cumulative value used as reference for abnormality is, for example, made a value slightly larger than the maximum value which the cumulative value of the output air-fuel ratio can take in the first air-fuel ratio region X when the downstream side air-fuel ratio sensor 41 does not suffer from deterioration of response and the degree of deterioration of the upstream side exhaust purification catalyst 20 is low.

On the other hand, when the cumulative value of the output air-fuel ratio when the output air-fuel ratio first passes through the first air-fuel ratio region X is larger than the cumulative value used as reference for normality, it is judged that the downstream side air-fuel ratio sensor 41 does not suffer from the abnormality of deterioration of response. It should be noted that the cumulative value used as reference for normality is, for example, made a value slightly smaller than the minimum value which the cumulative value of output air-fuel ratio can take in the first air-fuel ratio region X when the downstream side air-fuel ratio sensor 41 does not suffer from deterioration of response and the degree of deterioration of the upstream side exhaust purification catalyst 20 is low.

Further, when the cumulative value of the output air-fuel ratio when the output air-fuel ratio first passes through the first air-fuel ratio region X is between the cumulative value used as reference for abnormality and the cumulative value used as reference for normality, it is judged that it is unclear if the downstream side air-fuel ratio sensor 41 suffers from the abnormality of deterioration of response (state of abnormality is unclear) and that a hold should be put on judgment.

Further, in FIG. 9, $I_{2A}$ is the cumulative value of the output air-fuel ratio when as shown by the solid line A, the output air-fuel ratio first passes through the second air-fuel ratio region X. Further, in FIG. 9, $I_{2A}$ is the cumulative value of the output air-fuel ratio when as shown by the two-dot chain line D, the output air-fuel ratio first passes through the second air-fuel ratio region X. If comparing these cumulative values $I_{2A}$, $I_{2D}$, the cumulative value $I_{2A}$ is larger than the cumulative value $I_{2D}$. Therefore, it is determined that if the degree of deterioration of the upstream side exhaust purification catalyst 20 becomes higher, the cumulative value of the output air-fuel ratio when passing through the second air-fuel ratio region Y becomes larger.

Therefore, in the present embodiment, if it is judged that a hold should be put on judgment in the judgment based on the cumulative value of the output air-fuel ratio when the output air-fuel ratio first passes through the first air-fuel ratio region X, abnormality is diagnosed based on the cumulative value of the output air-fuel ratio when the output air-fuel ratio passes through the second air-fuel ratio region Y. Specifically, if the cumulative value of the output air-fuel ratio when the output air-fuel ratio first passes through the second air-fuel ratio region X is larger than the cumulative value used as reference for judgment of normality and abnormality, it is judged that the downstream side air-fuel ratio sensor 41 does not suffer from the abnormality of deterioration of response. On the other hand, when this cumulative value is smaller than the cumulative value used as reference for judgment of normality and abnormality, it is judged that the downstream side air-fuel ratio sensor 41 suffers from deterioration of response.

Therefore, summarizing these, in the present embodiment, if the cumulative value in the first air-fuel ratio region X is larger than the cumulative value used as reference for abnormality, it is judged that the downstream side air-fuel ratio sensor 41 has become abnormal, while if the cumulative value at the first air-fuel ratio region X is smaller than the normal reference cumulative value, it is judged that the downstream side air-fuel ratio sensor 41 is normal. Further, if the cumulative value in the first air-fuel ratio region X is between the cumulative value used as reference for abnormality and the cumulative value used as reference for normality, it is judged that a hold should be put on judgment. Further, if it is judged based on the cumulative value at the first air-fuel ratio region X that a hold should be put on judgment, when the second cumulative value of air-fuel ratio is larger than the cumulative value used as reference for judgment of normality and abnormality, it is judged that the downstream side air-fuel ratio sensor 41 is normal, when it is smaller than the cumulative value used as reference for judgment of normality and abnormality, it is judged that the downstream side air-fuel ratio sensor 41 has become abnormal. By diagnosing abnormality of the downstream side air-fuel ratio sensor 41 in this way, even if the upstream side exhaust purification catalyst 20 deteriorates, the abnormality of deterioration of response of the downstream side air-fuel ratio sensor 41 can be accurately diagnosed.

If expressing the above-mentioned first embodiment and second embodiment together, according to the embodiment of the present invention, the first change characteristic calculating means (ECU 31) calculates the first characteristic of change of air-fuel ratio when the output air-fuel ratio first passes through the first air-fuel ratio region. In addition, the second change characteristic calculating means (ECU 31) calculates the second characteristic of change of air-fuel ratio when first passing through the second air-fuel ratio region. Further, the abnormality diagnosing means (ECU 31) judges normality, abnormality, or whether a hold should be put on judgment (i.e. an unclear state of abnormality) for the state of the downstream side air-fuel ratio sensor 41, based on the first characteristic of change of air-fuel ratio. When based on the first characteristic of change of air-fuel ratio, it is judged that a hold should be put on judgment, it is judged if the downstream side air-fuel ratio sensor 41 is normal or abnormal in state, based on the second characteristic of change of air-fuel ratio.

As the characteristic of change of air-fuel ratio, in the above-mentioned embodiment, the speed of change of air-fuel ratio (time period of change of air-fuel ratio), cumulative value of air-fuel ratio, cumulative value of amount of exhaust gas passing through downstream side air-fuel ratio sensor 41 while the output air-fuel ratio changes from the upper limit air-fuel ratio to the lower limit air-fuel ratio in each air-fuel ratio region, etc. may be mentioned. However, as the characteristic of change of air-fuel ratio, a parameter other than the above parameters may be used so long as a parameter which exhibits a trend similar to the speed of change of air-fuel ratio etc. with respect to the presence or absence of abnormality of deterioration of response of the downstream side air-fuel ration 41 and the degree of deterioration of the upstream side exhaust purification catalyst 20.

REFERENCE SIGNS LIST

1. engine body
5. combustion chamber
6. intake valve
8. exhaust valve
11. fuel injector
19. exhaust manifold
20. upstream side exhaust purification catalyst
21. upstream side casing
23. downstream side casing
24. downstream side exhaust purification catalyst
31. electronic control unit (ECU)
40. upstream side air-fuel ratio sensor
41. downstream side air-fuel ratio sensor

The invention claimed is:

1. An electronic control unit (ECU) of an internal combustion engine comprising an exhaust purification catalyst arranged in an exhaust passage of the internal combustion engine and being able to store oxygen in inflowing exhaust gas and an air-fuel ratio sensor arranged at a downstream side of the exhaust purification catalyst in a direction of exhaust flow and detecting an air-fuel ratio of exhaust gas flowing out from the exhaust purification catalyst, performing a fuel cut control by stopping or decreasing a feed of fuel to a combustion chamber, and controlling an air-fuel ratio of exhaust gas flowing into the exhaust purification catalyst after the end of the fuel cut control to a rich air-fuel ratio richer than a stoichiometric air-fuel ratio as post reset rich control, wherein the ECU is configured to:

calculate a first characteristic of change of air-fuel ratio at the time the output air-fuel ratio of the air-fuel ratio sensor first passes a first air-fuel ratio region which is a part of an air-fuel ratio region of a stoichiometric air-fuel ratio or more, after an end of the fuel cut control, based on an output air-fuel ratio output from the air-fuel ratio sensor, calculate a second characteristic of change of air-fuel ratio at the time the output air-fuel ratio of the air-fuel ratio sensor first passes a second air-fuel ratio region different from the first air-fuel ratio region, after an end of the fuel cut control, based on an output air-fuel ratio output from the air-fuel ratio sensor, and judge if a state of the air-fuel ratio sensor is normal or abnormal based on the first characteristic of change of air-fuel ratio and, if a judgment cannot be made based on the first characteristic of change of air-fuel ratio, judge if the state of the air-fuel ratio sensor is normal or abnormal based on the second characteristic of change of air-fuel ratio.

2. The ECU of an internal combustion engine according to claim 1, wherein the first air-fuel ratio region includes an air-fuel ratio region leaner than the second air-fuel ratio region.

3. The ECU of an internal combustion engine according to claim 1, wherein the second air-fuel ratio region includes an air-fuel ratio region richer than the first air-fuel ratio region.

4. The ECU of an internal combustion engine according to claim 1, wherein the second air-fuel ratio region is a region including a stoichiometric air-fuel ratio.

5. The ECU of an internal combustion engine according to claim 1, wherein the air-fuel ratio sensor is a limit current type air-fuel ratio sensor outputting a limit current when an air-fuel ratio of exhaust gas passing through the air-fuel ratio sensor is within a predetermined air-fuel ratio region, and the first air-fuel ratio region and the second air-fuel ratio region are within the predetermined air-fuel ratio where the air-fuel ratio sensor generates a limit current.

6. The ECU of an internal combustion engine according to claim 1, wherein the first air-fuel ratio region is a region between a first region upper limit air-fuel ratio and a first region lower limit air-fuel ratio at a rich side from the first region upper limit air-fuel ratio, the second air-fuel ratio region is a region between a second region upper limit air-fuel ratio and a second region lower limit air-fuel ratio at a rich side from the second region upper limit air-fuel ratio, and the second region upper limit air-fuel ratio is leaner than the stoichiometric air-fuel ratio.

7. The ECU of an internal combustion engine according to claim 6, wherein the second region upper limit air-fuel ratio is richer than the first region lower limit air-fuel ratio.

8. The ECU of an internal combustion engine according to claim 6, wherein the second region lower limit air-fuel ratio is the stoichiometric air-fuel ratio or less.

9. The ECU of an internal combustion engine according to claim 1, wherein the first characteristic of change of air-fuel ratio is a first speed of change of air-fuel ratio which is a speed of change when an output air-fuel ratio of the air-fuel ratio sensor first passes through the first air-fuel ratio region, and the ECU is configured to judge that the air-fuel ratio sensor is abnormal when the first speed of change of air-fuel ratio is slower than a speed of change used as reference for abnormality, judge that the air-fuel ratio sensor is normal when the first speed of change of air-fuel ratio is faster than a speed of change used as reference for normality, and not provide a judgment when the first speed of change of air-fuel ratio is between the speed of change used as reference for abnormality and the speed of change used as reference for normality.

10. The ECU of an internal combustion engine according to claim 1, wherein the second characteristic of change of air-fuel ratio is a second speed of change of air-fuel ratio which is a speed of change when an output air-fuel ratio of the air-fuel ratio sensor first passes through the second air-fuel ratio region, and the ECU is configured to, when a judgment cannot be made based on the first characteristic of change of air-fuel ratio, judge that the air-fuel ratio sensor is normal if the second speed of change of air-fuel ratio is slower than a speed of change used as reference for judgment of normality and abnormality, and judge that the air-fuel ratio sensor is abnormal if the second speed of change of air-fuel ratio is faster than the speed of change used as reference for judgment of normality and abnormality.

11. The ECU of an internal combustion engine according to claim 9, wherein the speed of change of air-fuel ratio is calculated based on the time period during which the output air-fuel ratio of the air-fuel ratio sensor changes from the upper limit air-fuel ratio to the lower limit air-fuel ratio of the corresponding air-fuel ratio region.

12. The ECU of an internal combustion engine according to claim 1, wherein the first characteristic of change of air-fuel ratio is a first cumulative value of air-fuel ratio obtained by cumulatively adding the output air-fuel ratio when an output air-fuel ratio of the air-fuel ratio sensor is in the first air-fuel ratio region, and the ECU is configured to judge that the air-fuel ratio sensor is abnormal when the first cumulative value of air-fuel ratio is larger than a cumulative value used as reference for abnormality, judge that the air-fuel ratio sensor is normal when the first cumulative value of air-fuel ratio is smaller than a cumulative value used as reference for normality, and not provide a judgment when the first cumulative value of air-fuel ratio is between the cumulative value used as reference for abnormality and the cumulative value used as reference for normality.

13. The ECU of an internal combustion engine according to claim 1, wherein the second characteristic of change of air-fuel ratio is a second cumulative value of air-fuel ratio obtained by cumulatively adding the output air-fuel ratio when an output air-fuel ratio of the air-fuel ratio sensor is in the second air-fuel ratio region, and the ECU is configured to, when a judgment cannot be made based on the first characteristic of change of air-fuel ratio, judge that the air-fuel ratio sensor is normal when the second cumulative value of air-fuel ratio is larger than a cumulative value used as reference for judgment of normality and abnormality and judge that the air-fuel ratio sensor is abnormal when the second cumulative value of air-fuel ratio is smaller than the cumulative value used as reference for judgment of normality and abnormality.

14. The ECU of an internal combustion engine according to claim 1, wherein the first characteristic of change of air-fuel ratio is a first cumulative value of amount of exhaust gas obtained by cumulatively adding an amount of exhaust gas passing through an exhaust passage in which the air-fuel ratio sensor is arranged in the period from when an output air-fuel ratio of the air-fuel ratio sensor changes from an upper limit air-fuel ratio to a lower limit air-fuel ratio of the first air-fuel ratio region, and the ECU is configured to judge that the air-fuel ratio sensor is abnormal when the first cumulative value of amount of exhaust gas is larger than a cumulative value used as reference for abnormality, judge that the air-fuel ratio sensor is normal when the first cumulative value of amount of exhaust gas is smaller than a cumulative value used as reference for normality, and not provide a judgment when the first cumulative value of amount of exhaust gas is between the cumulative value used as reference for abnormality and the cumulative value used as reference for normality.

15. The ECU of an internal combustion engine according to claim 1, wherein the second characteristic of change of air-fuel ratio is a second cumulative value of amount of exhaust gas obtained by cumulatively adding the amount of exhaust gas passing through the exhaust passage in which the air-fuel ratio sensor is arranged in the period from when the output air-fuel ratio of the air-fuel ratio sensor changes from the upper limit air-fuel ratio to the lower limit air-fuel ratio of the second air-fuel ratio region, and the ECU is configured to, when a judgment cannot be made based on the first characteristic of change of air-fuel ratio, judge that the air-fuel ratio sensor is normal when the second cumulative value of amount of exhaust gas is larger than a cumulative value used as reference for judgment of normality and abnormality, and judge that the air-fuel ratio sensor is abnormal when the second cumulative value of amount of exhaust gas is smaller than the cumulative value used as reference for judgment of normality and abnormality.

16. The ECU of an internal combustion engine according to claim 1, wherein the ECU is programmed to judge that the exhaust purification catalyst is deteriorating when it is judged based on the first characteristic of change of air-fuel ratio that the air-fuel ratio sensor is normal and when it is judged based on the second characteristic of change of air-fuel ratio that the air-fuel ratio sensor is abnormal.

17. The ECU of an internal combustion engine according to claim 1, wherein the ECU is configure to light a warning light when it is judged that the air-fuel ratio sensor is abnormal.

* * * * *